166-273 SR

5/20/86 XR 4,589,488

United States Patent [19]

Schirmer

[11] Patent Number: 4,589,488

[45] Date of Patent: May 20, 1986

[54] METHOD FOR RECOVERY OF MINERAL RESOURCES

[75] Inventor: Robert M. Schirmer, Bartlesville, Okla.

[73] Assignee: Phillips Petroleum Company, Bartlesville, Okla.

[21] Appl. No.: 506,186

[22] Filed: Jun. 21, 1983

Related U.S. Application Data

[63] Continuation-in-part of Ser. No. 363,737, Mar. 30, 1982, abandoned.

[51] Int. Cl.[4] ..... E21B 43/22; E21B 43/24; E21B 43/28

[52] U.S. Cl. ..... 166/270; 166/59; 166/272; 166/273; 166/303; 208/433; 208/951; 299/5; 422/207; 423/591

[58] Field of Search ..... 299/4, 5; 166/303, 307, 166/272, 271, 59, 270, 273, 274, 275; 210/759, 764, 774; 422/28, 29, 36; 423/580, 584, 587, 591; 208/11 LE

[56] References Cited

U.S. PATENT DOCUMENTS

| | | | |
|---|---|---|---|
| Re. 15,789 | 3/1924 | Bibb | 422/36 |
| 3,387,655 | 6/1968 | Hurd | 166/270 |
| 3,757,861 | 9/1973 | Routson | 166/273 |
| 4,113,017 | 9/1978 | Hitzman | 166/303 |
| 4,155,982 | 5/1979 | Hunkin et al. | 299/5 X |
| 4,270,802 | 6/1981 | Grant et al. | 299/5 |
| 4,320,923 | 3/1982 | Lawes et al. | 299/5 |
| 4,337,979 | 7/1982 | Yan | 299/5 X |
| 4,425,307 | 1/1984 | De Vries | 299/5 X |

FOREIGN PATENT DOCUMENTS 52522 12/1941 Netherlands .

*Primary Examiner*—George A. Suchfield
*Attorney, Agent, or Firm*—Charles F. Steininger

[57] ABSTRACT

A method for the recovery of mineral resources, such as metallic minerals, petroleum, etc., from solid materials, such as subsurface earth formations, including; partially burning a hydrogen-containing fuel in the presence of an oxidizing agent under conditions to produce partial oxidation products, such as alcohols, hydrogen peroxide, aldehydes, ketones, etc., terminating the burning to prevent decomposition of the partial oxidation products and contacting the solid materials with the partial oxidation products and contacting the solid materials with the partial oxidation products and an alkaline or acidic material.

22 Claims, 6 Drawing Figures

METHOD FOR RECOVERY OF MINERAL RESOURCES

REFERENCE TO RELATED APPLICATIONS

The present application is a continuation-in-part of application Ser. No. 363,737, now abandoned, filed Mar. 30, 1982 by the present inventor.

BACKGROUND OF THE INVENTION

The present invention relates to the recovery of mineral resources from solid materials containing the same and apparatus therefor. In a more specific aspect, the present invention relates to the in situ recovery of mineral resources from subsurface earth formations containing the same and apparatus therefor.

Mineral resources broadly cover native, nonorganic or fossilized organic substances contained in the earth's crust and, in most cases, in subsurface earth formations. The fossilized organic substances, such as petroleum, tars, asphalts, kerogen, coal, etc., particularly petroleum and nonorganic minerals such as uranium, vanadium, thorium, gold, rare earth metals, etc., particularly uranium, are in great demand and quite valuable and therefore, it is important that methods and apparatus for the recovery thereof maximize the amount recovered, while at the same time simplifying and reducing the cost of such recovery.

Oil exists in subterranean formations or reservoirs in a wide variety of forms, in a wide variety of formations and under a wide variety of natural conditions. In most cases natural forces present in the reservoir permit the production of significant amounts of the oil by so-called primary recovery methods. Usually this is brought about by the fact that reservoir pressure, supplied by gas under pressure, either in solution in the oil or as a gas cap, water, etc. is sufficient to force the oil to the surface of the earth. In any event, these so-called primary recovery methods are capable of recovering only minor portions of the original oil in place due to depletion of the natural forces and other factors. In some cases, little or none of the oil can be produced by natural forces. Accordingly, a wide variety of supplemental or artifical recovery techniques have been employed and still more have been proposed in order to increase the recovery of oil from subterranean formations. If the artifical recovery technique is utilized in reservoirs having insufficient natural production forces it is often referred to as primary recovery and, if used immediately following discontinuance of primary recovery methods, such technique has been referred to as a secondary recovery technique. If a so-called secondary recovery technique is followed by another artifical recovery technique, the latter has often been referred to as tertiary recovery. However, the lines of demarcation among these three techniques have been obliterated to a certain extent and it is, therefore, best to refer to all such artifical recovery techniques, whether primary, secondary or tertiary, as "enhanced oil recovery" techniques. Irrespective of the name applied to the recovery technique, all such enhanced oil recovery techniques include the injection of a gaseous or a liquid fluid into one or more injection wells under a pressure sufficient to displace or drive at least a portion of the oil from the reservoir, i.e. above the reservoir pressure, and producing the thus displaced oil from one or more producing wells. Obviously, a wide variety of driving fluids or injection fluids and combinations thereof have been proposed. However, the basic drive fluids or injection fluids include air, natural gas, carbon dioxide, propane, steam, water, surfactants and polymers. Unfortunately, none of these materials is an ideal displacement fluid due to a number of factors which affect the amount of oil which can be recovered by enhanced oil recovery techniques.

It has long been recognized that the major factors which influence the amount of oil recovered by enhanced oil recovery techniques include the relative mobility of the reservoir oil and injected fluid, the wettability characteristics of the rock surfaces within the reservoir and the interfacial tension between the injected fluid and the reservoir oil.

Obviously, if plug-type flow of oil and displacing fluid from injection wells to production wells could be accomplished substantial amounts of the oil in place could be displaced. However, this is generally not accomplished because of the fact that most displacing fluids will travel faster through the reservoir than the oil because of adverse mobility ratios. While a rather simplistic explanation, the relatively low viscosity of gases, as opposed to the oil, causes the gas to follow paths of least resistance, with the result that the gas will channel through fractures and fissures, selectively pass through zones of higher permeability and in general contact a small area of the reservoir in passing from the injection well to the production well. In addition, gravity segregation of the injected gas and the oil causes the gas to rise to the top of the reservoir where it tends to ride over the top of the oil bank. Accordingly, while gases such as natural gas and air are usually readily available and relatively inexpensive, they are also relatively inefficient as displacing media under ordinary conditions. In addition, one must also consider the cost of compressing the gas to a pressure sufficient for displacement of the oil. On the other hand, liquids have a more favorable mobility ratio with respect to reservoir oil due primarily to their greater viscosity. Consequently, conventional water injection or waterflooding has been the most widely practiced enhanced oil recovery technique. However, the mobility ratio between water and reservoir oil is still generally poor. Accordingly, numerous modifications of conventional waterflooding have been proposed to overcome this problem. These include thickening the water with various materials, such as polymers, forming viscous water-oil emulsions by the use of surfactants, etc. Obviously, these thickening or emulsifying materials are expensive and cannot be used throughout the entire waterflood. Hence the thickening agent or emulsion is utilized only in that portion of the water in contact with the oil. An alternative is the injection of a small slug of polymer, generally having a viscosity greater than the viscosity of the oil, at the contact between the polymer and the oil, and a terminal viscosity, at the contact with the water, which is near that of the viscosity of water. Such graded concentration is usually logarithmic, from the viscosity of the reservoir oil to the viscosity of the water. In other variations, a thickening or viscosifying agent is preceded by one or more other displacing media and followed by water.

The wettability characteristics of the rock surfaces also affect displacement of oil by water. If the rock surfaces are oil wet, substantial amounts of the oil will adhere to the rock surfaces and resist displacement by the water. If the oil wettability of the rock surfaces can be altered either by decreasing the oil wettability or even reversing the wettability, to render the rock surface water wet, substantial improvement in oil displacement by water can be attained. Such reduction of oil wettability or reversal of wettability can also be accomplished by the utilization of surfactants. However, such surfactants are expensive and therefore must be utilized in limited quantities, generally as a slug ahead of a water drive.

The interfacial tension between a displacing fluid and reservoir oil is primarily dependent upon the ability of the two materials to mix. As a result miscible displacement techniques have been developed. For example, if natural gas is compressed to a sufficiently high pressure, usually above about 3000 psi, the gas can be rendered miscible with the reservoir oil. However, in some cases, if the miscibility pressure is too high to be practical or the reservoir cannot withstand pressures of this magnitude, this process cannot be used. In addition, the additional compression cost also adds to the cost of the project. Where applicable, however, this technique has proven quite effective. Similarily, at lower pressures, carbon dioxide can be rendered miscible with reservoir oils and miscible displacement can be carried out by displacing the oil with carbon dioxide. In addition to the advantage of the lower miscibility pressure, carbon dioxide has the advantage of a relatively high solubility in water. Consequently, techniques have been proposed in which a slug of carbon dioxide is followed by water or the carbon dioxide is dissolved in the water. At still lower pressures ethane and propane and mixtures thereof can be made miscible with reservoir oil. However, these materials, particularly propane, are expensive relative to the value of the oil displaced and accordingly can not be utilized in unlimited amounts. As a result the "propane slug process" has been developed in which a slug of propane is driven through the reservoir by gas, usually natural gas, under conditions such that the propane is miscible with the oil being displaced and with the driving gas. Again, while this technique is effective in appropriate reservoirs, utilization of gases as the drive fluid interjects the above-mentioned problems of mobility. Finally, under certain conditions, surfactants can be utilized in the miscible displacement of oil. At this point it should be recognized that the terms "miscible" and "miscibility", as they relate to enhanced oil recovery techniques, have been somewhat misused, for example by the use of terms such as "partial miscibility". However, what is generally meant by such terms is that one fluid is partially soluble in the other. Consequently, a more accurate definition of "miscible" or "miscibility", and the definition which will be utilized herein, is that the two fluids in question are mixable with each other in all proportions and of "solubility", where there is a limit to the amount of a material which is soluble in or will mix with a fluid. While miscibility between the reservoir oil and the displacing fluid can be said to be ideal to the extent that the oil-water interfacial tension is minimal, it is not necessary to obtain miscibility in order to reduce the oil-water interfacial tension and substantially improve displacement of oil by the drive fluid. Significant lowering of oil-water interfacial tension can be accomplished by the utilization of surfactants and highly effective immiscible displacement can be attained.

It is obvious from the above that the utilization of surfactants in enhanced oil recovery techniques has numerous advantages over the other techniques discussed. As previously indicated, the surfactant reduces the interfacial tension between a surfactant solution and reservoir oil and alters the oil wettability of the rock surfaces, thus substantially improving displacement of the oil. Secondly, since the surfactant solution is a liquid, it can be driven by water and the disadvantages of unfavorable mobility ratios, which are present when gases are used as drive fluid, are significantly reduced. Finally, enhanced oil recovery techniques utilizing surfactants can be utilized in reservoirs which have already been subjected to other recovery techniques, particularly where the reservoir has been produced to its economic limits by waterflooding. As a result, a substantial amount of research has been carried out in developing a wide variety of techniques utilizing surfactants and in improving the basic forms of these techniques. As previously indicated, because of the relative cost of surfactants, the surfactants are generally utilized in small amounts or in slug type operations in which the surfactant solution is driven through the reservoir by water.

The most basic of the surfactant techniques involves the injection of an aqueous surfactant solution, simply to reduce the oil-water interfacial tension. Such techniques are often referred to as "low tension waterflooding" techniques. Today one of the most promising low tension waterflooding tehniques involves the injection of aqueous solutions of petroleum sulfonates, having a predetermined equivalent weight range, under controlled conditions of salinity. This basic technique is further improved by sequential injection of a protective slug, the surfactant slug, a mobility control slug and finally water. The protective slug is an aqueous solution of sodium chloride which is injected in order to displace reservoir water ahead of the subsequently injected surfactant slug. The protective slug is usually substantially free of divalent ions which would tend to precipitate the subsequently injected surfactant. The surfactant slug comprises an aqueous solution of petroleum sulfonates and contains sodium chloride in a concentration, typically between about 1.0 to 7.0 weight percent, which will promote the desired low interfacia between the injected water and the reservoir oil. The subsequently injected mobility control slug is a thickened water slug containing a viscosifier or thickening agent, such as a water soluble biopolymer or polyacrylamide. The mobility control slug is preferably of logarithmically graded concentration in order to provide an initial viscosity greater than the viscosity of the reservior oil and a terminal viscosity near that of water. Finally, the driving fluid may be water from any source, but is usually brine present in the reservoir with the oil. In addition to petroleum sulfonates, a wide variety of synthetic sulfonates and complex sulfonates derived from either petroleum or synthetic sources have been proposed to further improve the process and overcome other problems which exist in certain reservoir environments.

As previously indicated, surfactants may be utilized under conditions to produce miscible or immiscible displacement of the oil. In addition, such surfactants have been used in systems which do not form microemulsions and those which do form microemulsions. In recent years considerable research has been devoted to the latter systems.

The microemulsions which have been proposed have been selected from compositions in the single phase region of a ternary diagram. Such microemulsion systems can be either oil-external microemulsions or water-external microemulsions. When such microemulsion systems are used, it is believed that the initial stages of oil recovery involve an efficient miscible displacement with subsequent immiscible displacement, upon the breaking down of the microemulsion into multiple phases due to dilution of the microemulsion with crude oil and reservoir water at its leading edge and dilution with the aqueous drive fluid at its trailing edge. Hence, optimization of such microemulsion surfactant systems is approached in terms of minimization of the multiphase region in the phase diagram so as to prolong miscible displacement with low interfacial tensions in the multiphase regions to thereby enhance immiscible displacement. From a practical standpoint, however, the development of effective microemulsion systems which can economically recover oil from a subterranean formation suffers from certain drawbacks in that it is difficult to maintain miscible displacement and it is difficult to obtain the low interfacial tensions necessary to provide effective immiscible displacement after miscible displacement ceases.

Surfactant systems have been developed which form microemulsions on contact with the reservoir oil. For example, U.S. Pat. No. 3,373,809 discloses recovering oil through the formation of a microemulsion formed in situ by injecting a surfactant system. This patent is based on the formation of a single phase microemulsion system with the reservoir oil by injecting a surfactant system to form the microemulsion system in situ. However, in order to achieve the desired results, extremely high concentrations of surfactant must be utilized. Such quantities of surfactant are usually in excess of about 7% to 15% by weight so as to provide a composition within the single phase region of a ternary diagram and, as such, can easily exceed the value of the oil recovered. Accordingly, it is becoming well recognized that it is impractical from an economic standpoint to maintain such a highly concentrated surfactant composition in the reservoir, which will remain effectively miscible throughout the lifetime of the operation, as proposed by the above patent and others.

Recent work has led to the suggestion of injecting microemulsion systems wherein the microemulsion phase is immiscible with the resident fluids in the reservoir. For example, U.S. Pat. No. 3,885,628 proposes to form a multiphase microemulsion system above ground by mixing oil, brine and surfactant and injecting at least the immiscible microemulsion phase. In some cases this patent suggests injecting one or more of the other phases, which exist in equilibrium with the microemulsion phase along the immiscible microemulsion phase. Later work, as set forth in U.S. Pat. No. 3,981,361, describes procedures for producing surfactant systems above ground are injected as an immiscible microemulsion. In this case emphasis is placed on the injection of the single immiscible surfactant-rich microemulsion phase. Also, U.S. Pat. No. 3,938,591 discusses the injection of immiscible microemulsion systems which resist uptake of oil and water into the immiscible microemulsion phase. In the last three techniques described, there is the obvious disadvantage of requiring the injection of a composition containing substantial amounts of oil which, of course, adds to the cost of the injected composition. In addition, there is the problem of achieving the optimum system for a given oil, since it turns out that different oils behave differently.

In order to overcome the above-mentioned and other difficulties incountered in the prior art use of surfactants in oil recovery, U.S. Pat. Nos. 4,079,785 and 4,125,156, which are incorporated herein by reference, disclose that an effective immiscible surfactant drive can be carried out by injecting a slug of surfactant solution comprising a surfactant, an electrolyte, water and, optionally, a cosurfactant to form a multiphase system in situ in the reservoir which comprises; at least two different regions, for example, an oil-rich region and a microemulsion region. The latter patent points out that best results are obtained when three different multiphase regions are formed, namely, a microemulsion, in equilibrium with an oil phase, a microemulsion in equilibrium with both an oil phase and a water phase and a microemulsion in equilibrium with a water phase. It is pointed out in this patent that among the variables which affect the three-phase region in which a particular system will partition are salinity, oil type, surfactant average equivalent weight, cosurfactant type and temperature. The patent also goes on to point out that, if all variables are fixed except the salinity, the system will shift from a microemulsion in equilibrium with an oil phase to a microemulsion in equilibrium with both an oil phase and a water phase to a microemulsion system in equilibrium with a water phase, as the salinity increases from zero. Finally, the patent sets forth a simple procedure which can be carried out in a laboratory to establish the system of water, electrolyte, surfactant and, optionally, cosurfactant and the proportions thereof which will be most effective for enhancing oil recovery when injected into the reservoir of interest.

While recent emphasis has been placed upon the use of petroleum sulfonates in surfactant waterflooding, numerous other surfactants have been proposed for use. For example, long chain organic acids, such as oleic, palmitic and stearic acids and the corresponding soaps have been suggested. Likewise sodium salts of so-called "tar acids", formed by adding to water-soluble tar acids, of the acid wash in petroleum refining, the alkaline wash liquids from the purification of crude oil fractions. Obviously, the latter proposal constitutes an effort to reduce the cost of the surfactant.

Also, while the previously mentioned surfactants are relatively inexpensive and the amounts utilized are small compared with the amount of drive water injected, the volume of surfactant necessary makes the cost of the surfactant a major factor. Consequently, a number of techniques have been proposed for reducing the cost of the surfactant.

One such technique is referred to as "caustic" or "alkaline" waterflooding. In this technique, an aqueous solution of an alkali metal or ammonium hydroxide or carbonate is injected into the reservoir in order to neutralize organic acids present in the reservoir oil and produce the corresponding alkali metal or ammonium salts. Thus, the surfactant is formed in situ. Alkaline waterflooding has been proposed in various recovery mechanisms to lower the interfacial tension between the reservoir oil and the injected water, to alter or even reverse the wettability of the reservoir rock or for the purpose of mobility control by the formation of a relatively viscous oil and water emulsion. In a variation of this technique, an aqueous alkaline solution is employed in which the alkalinity and monovalent salt salinity of the solution are controlled within defined ranges in order to result in low oil-water interfacial tensions which enhance the displacement of the oil. A thickened water slug may then be used for the purpose of mobility control following the injection of the alkaline solution.

The relative efficiency of an alkaline waterflood depends to some extent upon the total acid content of the reservoir oil. Accordingly, in some cases, insufficient naturally-occurring organic acids are present. Therefore variations of this procedure have been proposed in which air, peroxides or other oxidizing agents are injected into the reservoir in order to oxidize certain constituents of the oil in situ and form additional organic acids. Alternatively, a preoxidized oil bank may be injected or high molecular weight acids may be added to an injected oil bank. In any event, the aqueous alkaline solution is then injected in order to form the sodium salts of the naturally occurring organic acids, the added acids and/or those formed from the constituents of the oil in situ.

In most of these techniques the oxidation is inefficient, great care is required in the handling and use of oxidizing agents and most of the oxidizing agents are expensive to prepare.

Another technique for reducing the cost of surfactants and one which can be utilized where insufficient naturally-occurring organic acids are present in the reservoir oil, is the extraction of organic acids from materials containing the same, particularly from the reservoir oil itself, at the surface of the earth followed by neutralization to form salts or injection of the acid followed by injection of an aqueous alkaline solution to form the salts in situ. This surface extraction of acidic materials is, of course, advantageous to the extent that extracted acids can be accumulated to thereby inject the optimum amount into the formation rather than relying upon the acid content of the oil volume immediately adjacent the injection well. However, present techniques for extracting the acids from the acid-containing material leave much to be desired. One technique involves passing the oil through a solid ion exchange agent which adsorbs the acids by ion exchange. While high percentages of the acid present in the oil can be extracted by this technique, it is expensive and cumbersome. Solid ion exchange agents, usually used, are expensive and lose their effectiveness in time and as a result of the presence of contaminating ions in the oil. In addition, once the acids are adsorbed by the ion exchange resin they must be removed by passing an eluent through the resin to reverse the exchange and elute the acids therefrom. When the exchange capacity of the resin deteriorates it is also necessary to regenerate the resin and often precondition the resin, by an ion exchange mechanism, for further use. Eventually, however, where regeneration and renewal of the exchange capacity are ineffective the resin must be replaced. In another standard technique the oil is extracted with an aqueous solution of sodium hydroxide or an aqueous ethanol solution of sodium hydroxide. While this liquid-liquid extraction technique is simple and relatively inexpensive, the recovery of acids is extremely low, particularly by comparison to the ion exchange technique.

Along the same lines it has also been proposed that components of the oil be converted to sulfonate-type surfactants by treatment with formaldehyde and an alkaline sulfite and the thus recovered surfactants thereafter injected into the reservoir.

It is apparent from the above that present day techniques for the recovery of petroleum from subsurface earth formations utilizing surfactants are fraught with many problems, including the manufacture of such surfactants, the cost for such surfactants, the handling of materials for preparing surfactants and difficulties in the transportation and handling of such materials and/or the resultant surfactants, etc., all of which ultimately lead to high costs and inefficiencies.

As it will appear from the following discussion, many of the same problems encountered in the recovery of petroleum, as well as additional problems, are encountered in the recovery of metallic mineral resources.

Numerous metallic mineral resources are present in subsurface earth formations in very small quantities which make their recovery extremely difficult. However, in most instances, these minerals are also extremely valuable, thereby justifying efforts to recover the same. An example of one such mineral is uranium. However, numerous other valuable minerals, such as vanadium, thorium, gold, rare earth metals, etc., are also present in small quantities in subsurface formations, alone and quite often associated with uranium. Consequently, the recovery of such minerals is fraught with essentially the same problems as the recovery of uranium and, in general, the same techniques for recovering uranium can also be utilized to recover such other mineral values, whether associated with uranium or occurring alone.

Uranium occurs in a wide variety of subterranean strata such as granites and granitic deposits, pegmatites and pegmatite dikes and veins, and sedimentary strata such as sandstones, unconsolidated sands, limestones, etc. However, very few subterranean deposits have a high concentration of uranium. For example, most uranium-containing deposits contain from about 0.01 to 1 weight percent uranium, expressed as $U_3O_8$ as is conventional practice in the art. Few ores contain more than about 1 percent uranium and deposits containing below about 0.1 percent uranium are considered so poor as to be currently uneconomical to recover unless other mineral values, such as vanadium, gold and the like, can be simultaneously recovered.

There are several known techniques for extracting uranium values from uranium-containing materials. One common technique is roasting of the ore, usually in the presence of a combustion supporting gas, such as air or oxygen, and recovering the uranium from the resultant ash. However, the present invention is directed to the extraction of uranium values by the utilization of aqueous leaching solutions. There are two common leaching techniques for recovering uranium values, which depend primarily upon the accessibility and size of the subterranean deposit. To the extent that the deposit containing the uranium is accessible by conventional mining means and is of sufficient size to economically justify conventional mining, the ore is mined, ground to increase the contact area between the uranium values in the ore and the leach solution, usually less than about 14 mesh but in some cases, such as limestones, to nominally less than 325 mesh, and contacted with an aqueous leach solution for a time sufficient to obtain maximum extraction of the uranium values. On the other hand, where the uranium-containing deposit is inaccessible or is too small to justify conventional mining, the aqueous leach solution is injected into the subsurface formation through at least one injection well penetrating the deposit, maintained in contact with the uranium-containing deposit for a time sufficient to extract the uranium values and the leach solution containing the uranium, usually referred to as a "pregnant" solution, is produced through at least one production well penetrating the deposit.

The most common aqueous leach solutions are either aqueous acidic solutions, such as sulfuric acid solutions, or aqueous alkaline solutions, such as sodium carbonate and/or bicarbonate.

While aqueous acidic solutions are normally quite effective in the extraction of uranium values and act quite rapidly in the extraction of the uranium values, the volumes of acid consumed are usually quite high, thus making the use of aqueous acidic solutions relatively expensive. In addition, aqueous acidic solutions generally cannot be utilized to extract uranium values from ores or in situ from deposits containing high concentrations of acid-consuming gangue, such as limestone. While aqueous alkaline leach solutions are applicable to all types of uranium-containing materials and are less expensive than acids, the quantities of alkaline material necessary also make the use of these solutions expensive.

The uranium values are conventionally recovered from acidic leach solutions by techniques well known in the mining art, such as direct precipitation, selective ion exchange, liquid extraction, etc. Similarly, pregnant alkaline leach solutions may be treated to recover the uranium values by contact with ion exchange resins, precipitation, as by adding sodium hydroxide to increase the pH of the solution to about 12, etc.

As described to this point, the extraction of uranium values is dependent strictly upon the economics of mining versus in situ extraction and the relative costs of acidic leach solutions versus alkaline leach solutions. However, this is an oversimplification, to the extent that only uranium in its hexavalent state can be extracted in either acidic or alkaline leach solutions. While some uranium in its hexavalent state is present in mined ores and subterranean deposits, the vast majority of the uranium is present in its valence states lower than the hexavalent state. For example, uranium minerals are generally present in the form of uraninite, a natural oxide of uranium in a variety of forms such as $UO_2$, $UO_3$, $UO.U_2O_3$ and mixed $U_3O_8$ ($UO_2.2UO_3$), the most prevalent variety of which is pitch blende containing about 55 to 75 percent of uranium as $UO_2$ and up to about 30 percent uranium as $UO_3$. Other forms in which uranium minerals are found include coffinite, carnotite, a hydrated vanadate of uranium and potassium having the formula $K_2(UO_2)_2(VO_4)_2.3H_2O$, and uranites which are mineral phosphates of uranium with copper or calcium, for example, uranite lime having the general formula $CaO.2UO_3.P_2O_5.8H_2O$. Consequently, in order to extract uranium values from mined ores and subsurface deposits with aqueous acidic or aqueous alkaline leach solutions, it is necessary to oxidize the lower valence states of uranium to the soluble, hexavalent state.

Combinations of acids and oxidants which have been suggested by the prior art include nitric acid, hydrochloric acid or sulfuric acid, particularly sulfuric acid, in combination with air, oxygen, sodium chlorate, potassium permanganate, hydrogen peroxide and magnesium dioxide as oxidants. Alkaline leachants or oxidants heretofore suggested include carbonates and/or bicarbonates of ammonium, sodium or potassium in combination with air, oxygen or hydrogen peroxide as lixivants. However, sodium bicarbonate and/or carbonate have been used almost exclusively in actual practice. The most prevalent oxidant utilized in commercial operations is air for economic reasons. However, certain difficulties are encountered in the use of air to the extent that insufficient air can be dissolved in the leach solution at atmospheric pressure, thereby rendering the extraction process rather inefficient.

Hydrogen peroxide has been found to be a highly effective oxidant in either acidic or alkaline leach solutions but the many problems associated with such use tend to negate its advantages. While pure solutions of hydrogen peroxide, completely free of contaminants, are highly stable, such pure solutions are expensive and their purity almost impossible to maintain. On the other hand, concentrated solutions are highly toxic and strong irritants. In addition, in solution, hydrogen peroxide decomposes into water and oxygen, which decomposition is accelerated by the presence of impurities. Consequently, in using hydrogen peroxide as an oxidant for the recovery of uranium, the addition of hydrogen peroxide to the leach solution, prior to use, will result in rapid deterioration, particularly since such decomposition is accelerated by alkalis, and, hence, much more hydrogen peroxide than is necessary must be utilized even in the extraction of mined ore. This problem is even more exaggerated when hydrogen peroxide is utilized in leach solutions for in situ recovery of the uranium from subsurface earth formations. Since solid hydrogen peroxide is explosive, there is always the danger of fire and explosion in the event attempts are made to utilize the same in this form, as well as in solution.

As previously indicated, the expense of utilizing hydrogen peroxide is a major factor. This is due to the complexity of commercial methods for manufacture and separation of the hydrogen peroxide. One common method is the autooxidation of an alkylanthrahydroquinone, such as the 2-ethyl derivative, in a cylic continuous process in which the quinone the oxidation step is reduced to the starting material by hydrogen in the presence of a supported paladium catalyst. A second technique involves electrolytic processes in which aqueous sulfuric acid or acidic ammonium bisulfate are converted electrolytically to the peroxybisulfate which is then hydrolyzed to form hydrogen peroxide. A third method is the autooxidation of isopropyl alcohol. Of these techniques, the first mentioned is the most widely utilized. It is also known that hydrogen peroxide can be produced as a by-product by the autooxidation of paraffinic hydrocarbons, such as propane, to produce olefins. Efforts have also been made to maximize the production of hydrogen peroxide in this type reaction. However, no known commercial process utilizes this type of reaction and, hence, it has remained a laboratory curiosity.

The above discussion illustrates that the recovery of metallic mineral resources from subsurface earth formations is also subject to a number of problems, including cost of materials, the handling, transport and use of such materials, particularly oxidizing agents and other problems previously mentioned in connection with the recovery of petroleum, all of which again result in high costs and inefficient operations.

SUMMARY OF THE INVENTION

It is, therefore, an object of the present invention to provide an improved method and apparatus for recovering mineral resources from subsurface earth formations, which overcomes the above-mentioned and other problems of the prior art. Another object of the present invention is to provide an improved method and apparatus for recovering fossilized organic substances, particularly petroleum from subsurface earth formations which overcome the above-mentioned and other problems of the prior art. Yet another object of the present invention is to provide an improved method and apparatus for recovering oil from subsurface earth formations by the use of surfactants in which the preparation of such surfactants is greatly simplified, cost of preparation of such surfactants is reduced, problems of handling and the safety of materials for the preparation of such surfactants and the surfactants themselves is substantially improved, the use of such surfactants is simplified, the preparation of such surfactants is more efficient and/or the recovery of oil by such surfactants is more efficient and effective. Still another object of the present invention is to provide an improved method and apparatus for recovering metallic mineral resources, particularly uranium from solid materials containing the same which overcomes the above-mentioned and other problems of the prior art. Another object of the present invention is to provide an improved method and apparatus for recovering metallic mineral values from mined ores. A further object of the present invention is to provide an improved method and apparatus for recovering metallic mineral values from subsurface earth formations containing the same by in situ extraction. Another and further object of the present invention is to provide an improved method and apparatus for recovering metallic mineral values from solid materials containing such mineral values in their lower valence state. A further object of the present invention is to provide an improved method and apparatus for recovering metallic mineral values from solid materials containing such mineral values in their lower valence states by utilizing hydrogen peroxide to convert the mineral values to their higher valence state. Still another object of the present invention is to provide an improved method and apparatus for recovering metallic mineral values from solid materials containing such mineral values in their lower valence state in which hydrogen peroxide for conversion of the metallic mineral values to their higher valence state is generated in an inexpensive manner. Yet another object of the present invention is to provide an improved method and apparatus for recovering metallic mineral values from solid materials containing such mineral values in their lower valence states by the use of hydrogen peroxide to convert such mineral values to their higher valence states without encountering the dangers of handling hydrogen peroxide. Another and further object of the present invention is to provide an improved method and apparatus for recovering metallic mineral values from solid materials containing such mineral values in their lower valence state in which hydrogen peroxide, to convert such mineral values to a higher valence state, is utilized in a manner which overcomes the problems of removing the hydrogen peroxide from its reaction mixture. A further object of the present invention is to provide an improved method and apparatus for recovering metallic mineral values from solid materials containing such mineral values in their lower valence states in which hydrogen peroxide is utilized to convert such mineral values to a higher valence state while essentially eliminating the problems of decomposition of hydrogen peroxide. Another object of the present invention is to provide an improved method and apparatus for recovering metallic mineral values from solid materials containing such mineral values in their lower valence states in which hydrogen peroxide is utilized to convert such mineral values to a higher valence state while simultaneously generating an alkaline solution to leach said mineral values from the solid materials. A further object of the present invention is to provide an improved method and apparatus for recovering metallic mineral values from solid materials containing such mineral values in their lower valence states in which hydrogen peroxide is utilized to convert such mineral values to a higher valence state in conjunction with an alkaline leach solution. A still further object of the present invention is to provide an improved method and apparatus for recovering metallic mineral values from solid materials containing such mineral values in a lower valence state in which hydrogen peroxide is utilized to convert the mineral values to a higher valence state in conjunction with an acidic solution to leach the mineral values from the solid material. Still another object of the present invention is to provide an improved method and apparatus for recovering metallic mineral values including uranium from solid materials containing the same in accordance with the above and other objects. These and other objects of the present invention will be apparent from the following description.

In accordance with the present invention, mineral resources are recovered from solid materials containing such mineral resources by burning a hydrogen-containing fuel in the presence of an oxidizing agent under conditions sufficient to produce an effluent containing significant amounts of partial oxidation products, controlling the burning step to prevent significant decomposition of the thus produced partial oxidation products and the formation of products of complete oxidation therefrom, by selecting at least one of the type of hydrogen-containing fuel, the fuel/oxidizing agent equivalence ratio, the temperature, the pressure and the residence time and contacting the solid material containing the mineral resources with the effluent containing the partial oxidation products and a material selected from the group consisting of an alkaline material and an acidic material. In a preferred form, the solid material containing the mineral resources is a subsurface earth formation and the recovery is carried out in situ in the subsurface formation. In accordance with one aspect of the present invention, the mineral resources are fossilized organic substances, particularly petroleum, the partial oxidation products include an oxidizing agent, such as hydrogen peroxide, and the partial oxidation products are contacted with the solid materials containing the fossilized organic substance together with an alkaline material, whereby a portion of the fossilized organic substances are converted to acids and the alkaline material converts the acids to surfactants, or the partial oxidation products contain aldehydes, such as formaldehyde, and the partial oxidation products are contacted with the solid material containing the fossilized organic substance, together with an alkaline sulfite whereby a portion of the fossilized organic substance is converted to a surfactant and the resultant surfactants are utilized in an enhanced oil recovery technique for recovery of the petroleum. In accordance with another aspect of the present invention, the mineral resources are metallic mineral resources, particularly uranium, the partial oxidation products contain significant amounts of an oxidizing agent, such as hydrogen peroxide, and the solid material containing the metallic mineral resources is contacted with the partial oxidation products and an aqueous solution of an aqueous alkaline material or an aqueous solution of acidic material, whereby the oxidizing agent oxidizes the metallic mineral resource to a higher valence state in which they are soluble in aqueous solution and the aqueous solution extracts the metallic mineral resources from the solid material containing the same.

DETAILED DESCRIPTION OF THE PREFERRED EMBODIMENTS

Figure 1:
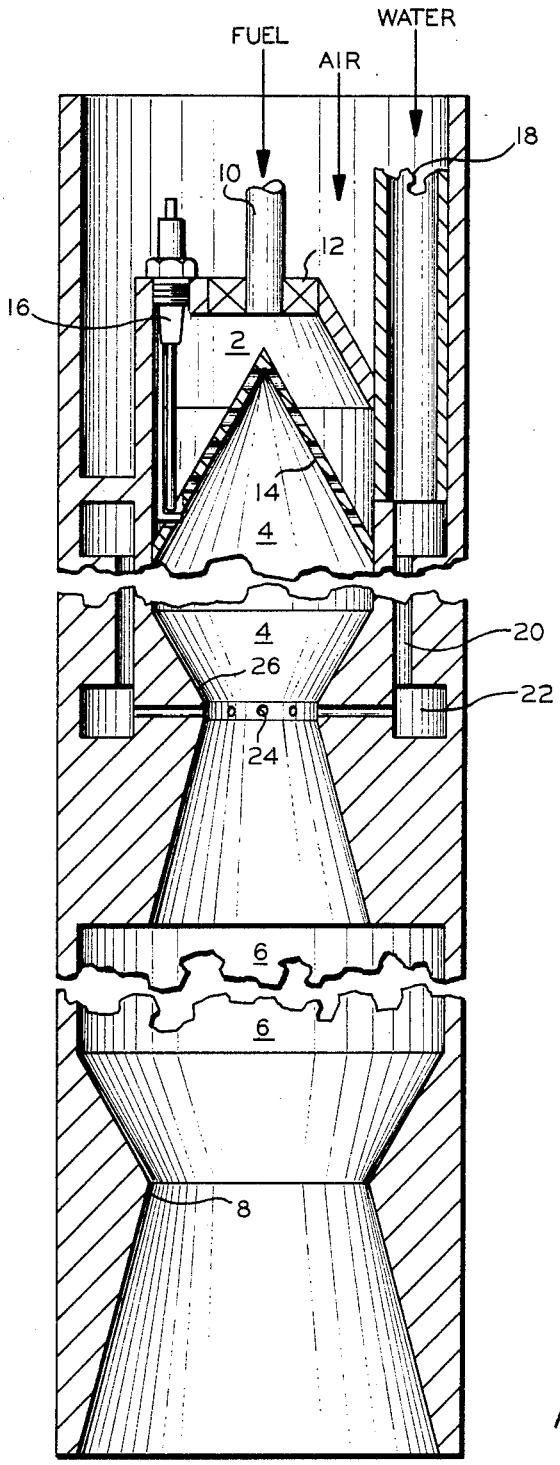
FIG. 1 of the drawings is a schematic view, partially in cross section, of a hydrogen peroxide generator, useful in accordance with the present invention.

When used herein, the term "solid material containing mineral resources" is meant to include any earth formation containing such mineral values, which has either been mined to thus produce an ore or which is located beneath the surface of the earth in its natural state as a subsurface earth formation.

The term "mineral resources", as used herein, is meant in its broad sense to refer to naturally-occurring fossilized organic substances, including without limitation, petroleum, tars, asphalts, coal, kerogen and the like, as well as naturally-occurring nonorganic metallic mineral resources, including without limitation, uranium, vanadium, thorium, gold, rare earth metals and the like.

The term "hydrocarbyl fuel" when utilized herein is meant to include normally gaseous, normally liquid and/or normally solid fuels containing hydrogen and carbon and capable of oxidation, combustion or burning.

The term "hydrogen-containing fuel" is meant to include normally gaseous, normally liquid and/or normally solid fuels containing hydrogen capable of producing hydrogen atoms or perhydroxal radicals upon oxidation, combustion or burning of the fuel.

The phrases "complete burning", "complete combustion" and "complete oxidation" are meant to include the oxidation, combustion or burning of a hydrogen-containing fuel or a hydrocarbyl fuel in the presence of an oxidizing agent to produce an effluent comprising carbon dioxide and water, in some cases carbon monoxide and nitrogen, and/or unburned or unoxidized fuel and relatively free of significant amounts of intermediate oxygen-containing products formed during oxidation, combustion or burning of a fuel to such utimate products.

The phrases "partial oxidation", "partial combustion" and "partial burning" are utilized herein to refer to the oxidation, combustion or burning of a hydrogen-containing fuel or a hydrocarbyl fuel under conditions to produce an effluent containing significant amounts of oxygen-containing intermediate products, including without limitation, hydrogen peroxide, aldehydes, ketones, ethers, esters, alcohols, and the like which are formed during an intermediate stage of oxidation, combustion or burning prior to the formation of the products of complete combustion referred to above and, more specifically carbon dioxide, water, in some cases, carbon monoxide and nitrogen, and/or unburned fuel. The products of such partial oxidation, combustion or burning are referred to as "partial oxidation products".

The term "oxidizing agent" is meant to include air, oxygen or other oxygen-containing materials capable of supporting oxidation, combustion or burning of a fuel.

The term "quench fluid" is meant to include air, water, mixtures thereof, or other gases, liquids or vapors adapted to terminate the combustion or burning of a fuel and/or cool the partial oxidation products.

The terms "fuel-air equivalence ratio", "equivalence ratio" and the symbol "$\phi$" employed herein to refer to the ratio of the fuel flow (fuel available) to the fuel required per stoichoimetric combustion with the air available. Stated in another way, said equivalence ratio is the ratio of the actual fuel-air mixture to the stoichoimetric fuel-air mixture. For example, an equivalence ratio 1.5 means the fuel-air mixture is fuel-rich and contains 1.5 times as mauch fuel as a stoichoimetric mixtrue and a equivalence ration of 0.5 means the fuel-air mixture is fuel-lean and contains 0.5 times fuel as a stoichoimetric mixture. Obviously, a stoichoimetric mixture by this definition has an equivalence ratio of 1.0.

When the term "water" is herein, with reference to the fluids injected into the flame front for purposes of cooling the same, this term is meant to include water in its liquid or vapor state and consequently water in its liquid state, mixtures of water in a liquid state and steam or steam.

When utilized in the present application and in the claims, the term "leachant" or "lixiviant" or "leach solution" is meant to include any acidic or alkaline material whose aqueous solution is adapted to dissolve and retain in solution the mineral values in question.

When the terms, "alkaline" and "alkaline material" are utilized in the present application, this term is meant to include materials having an alkali metal, an alkaline earth metal or an ammonium cation.

The term "acidic" is utilized in the present application to refer to any of the well-known acidic materials capable of extracting metallic mineral resources from solid materials containing the same.

When mineral values are referred to herein as "in their lower valence states", this term is meant to include such mineral values which can exist in several valence states and which are normally insoluble in aqueous leach solutions in such lower valence states but which when oxidized to their highest or a higher valence state are rendered soluble in such aqueous leach solutions. For example, with respect to uranium, when uranium is in a valence state lower than the hexavalence state, it is insoluble in conventional aqueous leach solutions but in the hexavalence state it is soluble in such leach solutions and can be washed from or extracted from solid material containing the same.

During the course of combustion of any hydrocarbyl fuel or hydrogen-containing fuel, a large number of intermediate reactions occur prior to attainment of complete combustion of the fuel to essentially carbon dioxide, water and, to the extent air is utilized as an oxidizing agent, nitrogen. During the course of such combustion, certain reactions such as cracking, dehydrogenation, hydrogenation and the like occur, resulting in intermediate products of combustion essentially free of oxygen, such as other hydrocarbons and carbon.

However in the context of the present application such oxygen-free intermediate products are considered inert. On the other hand, a wide variety of other reactions occur prior to complete combustion of the fuel by combination of the original components of the fuel and/or the above-mentioned oxygen-free intermediate products with an oxidizing agent to produce a wide variety of oxygen-containing, partial oxidation products or intermediate products, for example hydrogen peroxide, aldehydes, ketones, ethers, esters, alcohols, organic peroxides and the like. Ordinarily, unless the oxidation combustion or burning is controlled in some manner, the ultimate effluent will be essentially products of complete combustion, including carbon dioxide, water, in some cases carbon monoxide, where air is the oxidizing agent, nitrogen, in some cases unburned fuels and intermediate products, such as carbon and hydrocarbons and in some cases excess oxidizing agents and containing insignificant amounts of oxygen-containing, intermediate products or oxygen-containing, partial oxidation products. On the other hand, in accordance with the present invention, partial oxidation can be carried out to produce effluents containing significant amounts of oxygen-containing, intermediate products or oxygen-containing, partial oxidation products by controlling at least one of fuel/oxygen equivalence ratio, the temperature, the residence time, the type of hydrocarbon fuel and the pressure during the combustion process. It should be recognized at this point that these conditions are interrelated and, in certain cases, control of one of these conditions results in control of one or more of the other conditions.

Within the realm of the control of the fuel-oxygen equivalence ratio, combustion can be carried out under fuel-rich conditions, that is at an equivalence ratio above 1.0, at the stoichiometric ratio, that is an equivalence ratio of 1.0, or fuel-lean and oxygen-containing, partial oxidation products can be produced under all of these conditions. Conbustion of a fuel-rich mixture will thus produce hydrogen peroxide, aldehydes, alcohols and other oxygen-containing, partial oxidation products in varying amounts depending upon the other conditions employed. Since there is an excess of fuel when equilibrium is reached, the effluent will contain significant amounts of oxygen-containing, partial oxidation products, such as hydrogen peroxide, aldehydes, alcohols and other oxygen-containing materials. However, hydrogen peroxide is highly unstable and it is, therefore, necessary to limit the residence time, as hereinafter pointed out, to a time less than that necessary to reach equilibrium. While aldehydes, alcohols and other oxygen-containing materials are more stable than the hydrogen peroxide and can be found in significant quantities in a fuel-rich combustion effluent, they are somewhat less stable than products of complete combustion, such as carbon dioxide and water and, therefore, in order to maximize the production of these oxygen-containing, partial oxidation products, the residence time should also be less than that necessary for reaching equlibrium. On the other hand, where a stoichiometric mixture or a fuel-lean mixture (excess oxygen) is burned, products of complete combustion will be present when equilibrium is reached and, accordingly, it is necessary to limit the residence time to a residence time less than that necessary to reach equilibrium. It is also to be recognized, in this connection, that excess fuel also acts as a diluent or essentially inert material and thus to some extent moderates the temperature.

Limitation of the burning to partial oxidation or partial combustion, as opposed to complete oxidation or combustion, can also be controlled to a certain extent by controlling the combustion temperature. Within the normal deflagration, detonation or explosive range, where the combustion is self sustaining, the temperature may be a high temperature or a low temperature. Higher temperatures can, of course, be attained by preheating the fuel and/or oxidizing agent, controlling loss of heat by radiation from the flame, etc. It should be recognized here that such preheating is necessary in some cases, particularly where a heavy liquid fuel is to be utilized, since such preheating will aid in mixing of the fuel and the oxidizing agent. Lower temperatures can be attained by diluting the fuel-oxygen mixture, as with excess hydrocarbons, as pointed out above, or inert materials, such as nitrogen, excess oxidizing agent, water and the like. Lower temperatures can also be attained by indirect heat exchange with a cooling fluid such as water, removing heat radiated by the flame, as by carrying out the reaction in a metallic combustion zone cooled by water, air or the like, etc. In any event, operating at lower temperatures increases the production of oxygen-containing, partial oxidation products to the extent that it reduces or delays the breakdown of such partial oxidation products and extends the residence time for complete combustion. However, again, to maximize the production of oxygen-containing, partial oxidation products, the residence time should be controlled whether high or low temperature combustion is carried out.

The type of hydrocarbon, that is whether saturated, unsaturated, aromatic, etc., as well as the molecular weight of the hydrocarbon fuel, also has an effect upon the production of partial oxidation products, as opposed to products of complete combustion. Therefore, selective use of the fuel can also be utilized to control combustion to produce partial oxidation products.

Pressure control also has an effect upon the production of oxygen-containing, partial oxidation products and thus favor these materials as opposed to products of complete combustion. For example, at a high pressure the ignition temperature of the fuel is lowered and, to the extent liquid or solid fuels are utilized, aids in mixing and, again, more rapid combustion. This, of course, also affects the residence time which can be utilized.

As is apparent from the above, the primary factor, in carrying out partial oxidation to produce oxygen-containing, partial oxidation products, in accordance with the present invention, is control of the residence time. Consequently, in most cases, it is necessary to control the residence time to one below that necessary to reach equilibrium and/or complete combustion and, in the remaining cases, it is highly desirable to do so in order to maximize the production of oxygen-containing, partial oxidation products, which are useful as microorganism control materials. Control of the residence time can be accomplished by cooling. However, it is preferred that the residence time be controlled by rapidly terminating the combustion or rapidly quenching by injecting a quench fluid into the flame front. Such rapid termination of the combustion or rapid quenching is described in detail hereinafter, particularly with reference to the drawings.

Control of the above-mentioned conditions can also be utilized to control the product mix of the oxygen-containing, partial oxidation products. In a broad sense, severe conditions favor the production of hydrogen peroxide, mild conditions favor the production of alcohols, peroxides, ketones, ethers, esters and acids and intermediate conditions favor the production of aldehydes. Further, a fuel-lean equivalence ratio favors the production of hydrogen peroxide, while a stoichiometric or fuel-rich equivalence ratio will favor the production of aldehydes, alcohols and other oxygen-containing partial oxidation products. Higher temperatures favor the production of hydrogen peroxide whereas the lower temperatures favor the production of aldehydes and still lower temperatures favor the production of alcohols.

Since, as is apparent from the above, the quantity of oxygen-containing, partial combustion products and the quantities of individual oxygen-containing partial products to be produced, in accordance with the present invention, will vary in accordance with the nature of the fuel utilized and other operational factors, it is not possible to set forth specific limits herein. However, one skilled in the combustion art can determine the proper limits by laboratory tests in a combustor of the character hereinafter described while varying individual conditions until significant amounts of oxygen-containing, partial oxidation products are produced of the desired type and quantity sufficient to recover mineral resources from solid materials.

In addition to the above variations, partial oxidation, in accordance with the present invention, can be carried out as a high intensity-type combustion or low intensity-type combustion. As generally understood in the art, high intensity combustion is combustion in which the fuel and oxidizing agent are premixed or nearly instantaneously mixed in the reactor and thus, combustion approaching that in a well stirred reactor takes place. By contrast, low intensity combustion is akin to combustion in a large furnace where the air and fuel are not premixed or are not mixed essentially instantaneously but are mixed by diffusion. In accordance with the present invention, high intensity combustion is preferred. Accordingly, in order to illustrate the practice of the present invention, such high intensity partial combustion will be described for production of oxygen-containing, partial oxidation products, wherein the amount of hydrogen peroxide is maximized.

The present invention provides an efficient, effective and economical means of generating hydrogen peroxide, which overcomes the problems of the prior art in the utilization of hydrogen peroxide, and utilizing the thus produced hydrogen peroxide to recover mineral resources from solids. This is accomplished by burning a hydrogen-containing fuel in the presence of an oxidizing agent under conditions sufficient to produce a flame front containing significant amounts of hydrogen peroxide. The hydrogen-containing fuel may include any normally gaseous fuels, such as methane, ethane, propane, butane, etc., particularly natural gas, normally liquid fuels, including various petroleum fractions, diesel fuels, fuel oils, crude oils, alcohol, etc., as well as normally solid fuels, preferably ashless fuels, such as, asphaltene bottoms, solvent refined coal oils, shale oils, etc., provided only that such fuel is capable of producing hydrogen atoms or perhydroxal radicals when burned. There are some differences of opinion as to the mechanism of the reaction, i.e., whether as a result of the production of hydrogen atoms or perhydroxal radicals, but in any event, further reaction of the hydrogen or the perhydroxal radical with oxygen forms hydrogen peroxide. In addition to hydrogen peroxide, the reaction can produce varying amounts of carbon monoxide, carbon dioxide, hydrogen, water, unsaturated hydrocarbons, organic acids, ketones, aldehydes, ethers, esters, organic peroxides and alcohols. However, it has been found, in accordance with the present invention, that, if the fuel-oxygen mixture is substantially below the stiochiometric ratio, to produce a fuel-lean mixture, and the residence time is extremely short, the production of hydrogen peroxide will be maximized. Specifically, the fuel/air equivalence ratio should be between about 0.1 and 0.6, and more preferably between about 0.1 and 0.2, and the residence time should be between about 1 and 10 preferably between about 1 and 3 milliseconds.

The reaction should also be carried out at a relatively high temperature, preferably between about 800° and 1300° F., since, at this temperature, the production of hydrogen peroxide is increased at the expense of oxygenated organic materials. The maintenance of a proper temperature in the reactor can also be aided by preheating the air to temperatures between ambient temperature up to about 800° F. Where heavy, normally liquid fuels are utilized, it is also advantageous to preheat the fuel so that it can be readily atomized and mixed with the air. The temperature in the burning zone can also be controlled to a certain extent, by dilution of the fuel-air mixture with water. This also prevents undesirable side reactions such as cracking of the hydrocarbons.

Significant quantities of hydrogen peroxide can also be produced with fuel-oxygen ratios above the stoichiometric ratio, utilizing longer residence times and at lower temperatures. Under such conditions, the production of organic compounds, including aldehydes and alcohols increases, particularly at lower temperatures. On the other hand, at higher temperatures the concentration of hydrogen peroxide and olefins increases.

The fuel and air are preferably premixed prior to burning or combustion and suitable techniques for accomplishing this will be apparent from the description of the apparatus. In addition, it is highly desirable that the fuel and air pass through the combustion zone as an annularly stratified body with a fuel-rich core and an outer fuel-lean annular shell. Such stratification of the fuel-air mixture in the combustion zone has numerous advantages, including flame stabilization at the very high flow velocities hereinafter mentioned, protection of the walls of the combustion zone, as will be hereinafter detailed, and prevention of decomposition of the hydrogen peroxide, which is known to occur when certain materials, such as metals, are utilized for the walls of the combustion zone.

As previously indicated, the burning should be carried out at a very high flow velocity, preferably above about 250 feet per second. If the burning proceeds too slowly, there is also a tendency for the hydrogen peroxide to decompose before the hereinafter mentioned termination of the reaction.

Where premixing of the fuel and air is performed in the apparatus prior to combustion, it is also desirable to prevent flashback of the flame into the mixing zone. This will be more apparent when reference is made to suitable apparatus for carrying out the present invention.

Another very critical factor in the operation of the present invention is the rapid termination of the reaction by, at least in part, injecting additional air and/or water into the flame front. This rapid termination or quenching prevents the reaction from reaching equilibrium and thus, decomposition of the hydrogen peroxide. The rapid termination or quenching is further aided by the manner of introducing the quenching fluid, for example, as a plurality of radially directed jets, also abruptly expanding the flame front immediately adjacent the point of introduction of the quenching fluid and, preferably, reducing the peripheral dimension of the flame front prior to such expansion and introducing the quench fluid before the reduction in dimension, in the reduced dimension portion of the flame front or immediately after reduction in the dimension of the flame front. The manner of doing this will also be explained in more detail in discussing the apparatus.

In accordance with one aspect of the present invention, naturally occurring, fossilized organic substances are recovered from solid materials containing the same by burning a hydrogen-containing fuel or a hydrocarbyl fuel under conditions sufficient to produce partial oxidation products as an effluent and contacting the solid material containing the fossilized organic substances with such effluent and an alkaline material. More specifically, the partial oxidation products, together with the alkaline material react with certain components of the fossilized organic substance to form surfactants and the surfactants are utilized for the extraction of additional quantities of the fossilized organic substance from the solid materials containing the same. The nature of the partial combustion products in accordance with the present invention, results in the formation of surfactants by one or both of two types of reaction. In one instance, oxidizing agents present in the partial oxidation products, particularly hydrogen peroxide, oxidize certain components of the fossilized organic material to form acids primarily carboxylic acids and the alkaline material converts the acids to the corresponding surfactants, primarily carboxylates. Thus where it is desired that this reaction predominate, the combustion is carried out under conditions to maximize the hydrogen peroxide content of the effluent. The other reaction which takes place is believed to be a condensation reaction in which formaldehyde from the partial oxidation products and an alkaline sulfite react with components of the fossilized organic substances and to some extent, with certain other components of the partial oxidation products by a "sulfoalkylation or a sulfomethylation reaction" to form surfactants primarily sulfonate-type surfactants. Such a reaction is described in "The Sulfomethylation Reaction" by C. M. Suter, R. K. Bair and F. G. Bordwell, *Journal Of Organic Chemistry,* 10, 470 (1945). Specifically, formaldehyde and an alkaline sulfite, such as sodium sulfite, react with phenolic substances, ketones (which are known to be present in partial oxidation products, as well as the fossilized organic material) and esters (which are also known to be present in the partial oxidation products and the fossilized organic materials) by the replacement of an active hydrogen atom by an alkaline sulfolalkyl group ($-CH_xSO_3M$). Where it is desired that this reaction predominate, the partial combustion is carried out under conditions to maximize the formaldehyde content in a partial oxidation effluent. Since the effluent for the partial oxidation will generally contain quantities of both hydrogen peroxide and formaldehyde, both reactions can be carried out simultaneously by the addition of an alkaline neutralizing agent, such as sodium hydroxide, and an alkaline sulfite, such as sodium sulfite or sodium bisulfite, to form the surfactants by sulfoalkylation. In the case of the oxidizing agent, particularly hydrogen peroxide, catalytic amounts of an oxidation catalyst, such as vanadium pentoxide, potassium permanganate may be contacted with the fossilized organic substances together with the partial oxidation products. This may be done in various ways, for example by separately introducing the catalyst in a carrier fluid, such as air and aqueous solutions and simultaneously contacting the solid materials at the same time as the partial oxidation products, or it may be added to the partial oxidation products, as in the quench fluid. Also, where the oxidizing agents are present in the partial oxidation products, in addition to carboxylates, phenolates may also be generated and since fossilized organic substances, particularly crude oils, contain nitrogen and sulfur compounds, surfactants such as amine oxides, sulfoxides, sulfones and sulfonates can also be produced. Certain of these other surfactants may also be produced in the sulfoalkylation reaction. The alkaline material may also be added in several different manners and at several different stages. For example, it can be added at a separate aqueous solution simultaneously with the contact of the partial oxidation products with the fossilized organic material or in an aqueous solution utilized to quench partial oxidation products or separately after the injection of the partial oxidation products.

In the utilization of the above-described surfactants for the recovery of fossilized organic substances from a solid material, the surfactants are utilized in the manner described in the introductory portion hereof for enhanced oil recovery or surfactant flooding. It should be recognized, however, that these techniques are also applicable to a mined solid material, such as oil shales, tar sands and the like. However, the surfactants are preferably utilized to extract petroleum from subsurface earth formations in accordance with the previously mentioned conventional enhanced oil recovery techniques utilizing surfactants or surfactant waterflooding techniques.

This may be done by positioning the generator at the surface of the earth and passing the effluent through a wellhead and thence down the well to the formation to be treated, positioning the generator in the wellhead and passing the effluent down the well to the formation to be treated or positioning the generator down the wellbore at a point immediately adjacent the formation to be treated. Where the generator is located at the surface of the earth or in the wellhead, it will be advantageous to quench the flame front with air, rather than water, pass the quenched effluent down tubing in the well and separately introduce any water or aqueous fluid down the annulus between the tubing and the well casing. By operating in this manner, the problems of decomposition of hydrogen peroxide and passing the same from the surface to the subsurface formation are substantially eliminated, since significant decomposition does not occur until the hydrogen peroxide contacts the water. In addition, the problems of handling hydrogen peroxide solutions, or the like, are also eliminated, even if a conventional operation were carried out in which water or an aqueous fluid and the hydrogen peroxide were separately injected into the well and then mixed adjacent the formation to be treated. However, the much preferred method of operation is to lower the generator into the well bore, generate the partial oxidation products immediately adjacent the formation to be treated and contact the formation with the generated effluent substantially immediately after generation of the effluent. The obvious advantages of such an operation appear from the above discussion, but it should be emphasized that the elimination of problems with the generation of hydrogen peroxide, the handling of hydrogen peroxide, the known tendency of hydrogen peroxide to deteriorate and the problems of air pollution are significant. The fact that the effluent is at an elevated temperature and an elevated pressure are also quite distinct advantages, since the elevated pressure will aid in forcing the water into and through the formation. Normally, the effluent and water are introduced into an injection well, then passed through the formation to be treated and are then produced from a production well.

While the effluent from the generator will, in most cases, contain other by-products, such as various oxygen-free hydrocarbons, these materials will not adversely affect the recovery of oil from a subsurface formation. As a matter of fact, some may even aid in the recovery. Also, to the extent that these by-products are recovered with fluids produced after contacting the solid materials, they can be separated from the produced fluids and utilized for other purposes. For example, if propane or the like is utilized as a fuel or the fuel contains alkyl hydrocarbons, significant amounts of olefins are known to be produced. These olefins can be recovered and ultimately utilized as a fuel or for other purposes.

The recovery of the fossilized organic substances, particularly petroleum, with the surfactants, may be carried out under conditions to produce miscible or immiscible displacement of oil or the surfactants can be utilized in the manner to form microemulsions or where no microemulsions are formed. Preferably, however, the surfactants are utilized in accordance with procedures set forth in U.S. Pat. Nos. 4,079,785 and 4,125,156, which are incorporated herein by reference, to produce an immiscible surfactant drive by passing a slug of surfactant solution comprising the surfactant and an electrolyte, preferably a monovalent metal electrolyte, such as sodium chloride, water and optionally a cosurfactant to form a multiphase system in situ in the reservoir, which comprises at least two different regions, for example an oil rich region and a microemulsion rich region through the formation. The cosurfactant can be an alcohol, phenol, amine, mercaptan, glycol, or amide of 1 to 20 carbon atoms per molecule, which have been ethyloxated or propoxylated with an average of 1 to 12 ethylene oxide and propylene oxide units per molecule. However, the preferred cosurfactant is an alcohol. This, too, is quite fortuitous in accordance with the present invention. Specifically, as previously pointed out, the partial oxidation products of the present application usually will contain certain alcohols, the character of which depend upon the fuel utilized, and the conditions of operation of the partial oxidation can be carried out in a manner to maximize the production of alcohols. Accordingly, any alcohols present during the generation of the oxidizing agent or the sulfoalkylation agent will be present and helpful in admixture with the resultant surfactants. In addition, however, the cosurfactant can be injected after the injection of the partial oxidation effluent. Thus the alcohol may be alcohol from an outside source. However, in a preferrred technique, the alcohol will also be generated by partial oxidation. Specifically, after sufficient partial oxidation products have been generated to produce oxidizing agents and/or sulfolalkylation agents, the conditions of operation of the partial oxidation generator can be altered in order to maximize the production of alcohols and thus partial oxidation products enriched in alcohols injected immediately following the partial oxidation products containing oxidizing agents and/or sulfoalkylation agents.

As previously pointed out, preferred techniques of enhanced oil recovery with surfactants usually precede a surfactant slug by a protective or preflush slug, which is an aqueous solution of sodium chloride injected in order to displace reservoir water ahead of the subsequently injected surfactant. The protective slug is substantially free of divalent ions which would tend to precipitate the subsequently injected surfactant. After formation of the surfactant or the surfactant and alcohol in accordance with the present invention, a mobility control slug is injected. This mobility control slug is a thickened water slug containing a viscofier or thickening agent, such as a water soluble biopolymer or polyacrylamide. The mobility control slug is preferably of logarithmically graded concentration in order to provide an initial viscosity greater than the viscosity of the reservoir oil and a terminal viscosity near that of water. Finally, the driving fluid may be water from any source but is usually brine present in the reservoir with the oil.

In accordance with another aspect ofthe present invention, valuable metallic mineral resources are recovered from solid materials containing relatively small amounts of such mineral values. The invention is applicable to the recovery of such mineral values from any solid material containing the mineral values, including mined ores and particularly from subsurface earth formations by in situ extraction techniques. The mineral values of interest herein are multivalent mineral values, which in many cases, are present in earth formations in their lower valence states in which they are insoluble in aqueous leach solutions. As previously pointed out, in order to recover such multivalent mineral values existing in their lower valence states, it is necessary to oxidize the same to a higher or their highest valence state, for example, convert uranium in its lower valence states to the hexavalence state, in which state they are soluble in aqueous leach solutions. Therefore, the present invention provides an efficient, effective and economical means of generating hydrogen peroxide, which overcomes the problems of the prior art in the utilization of hydrogen peroxide and utilizing the thus produced hydrogen peroxide to oxidize the mineral values and render them soluble in aqueous leach solutions. This is accomplished by burning a hydrogen-containing fuel in the presence of oxygen under conditions sufficient to produce a flame front containing significant amounts of hydrogen peroxide. The hydrogen-containing fuel may include any normally gaseous fuels, such as methane, ethane, propane, butane, etc., particularly natural gas, normally liquid fuels including various petroleum fractions, diesel fuels, fuel oils and crude oils, as well as normally solid fuels, preferably ashless fuels, such as, asphaltine bottoms, solvent refined coal oils, shale oils, etc., provided only that such fuel is capable of producing hydrogen atoms or perhydroxal radicals when burned. There are some differences of opinion as to the mechanism of the reaction, i.e., whether as a result of the production of hydrogen atoms or perhydroxal radicals, but in any event, further reaction of the hydrogen or the perhydroxal radical with oxygen forms hydrogen peroxide. In addition to hydrogen peroxide, the reaction can produce varying amounts of carbon monoxide, carbon dioxide, hydrogen, water, unsaturated hydrocarbons, organic acids, ketones, aldahydes and alcohols. However, it has been found in accordance with the present invention that if the fuel-oxygen mixture is substantially below the stiochiometric ratio, to produce a fuel-lean mixture, and the residence time is extremely short, the production of hydrogen peroxide will be maximized. Specifically, the fuel/air equivalence ratio should be between about 0.1 and 0.6 and more preferably between about 0.1 and 0.2 and the residence time should be between about 1 and 10 milliseconds and preferably between about 1 and 3 milliseconds.

The reaction should also be carried out at a relatively high temperature, preferably between about 800° and 1300° F., since at this temperature, the production of hydrogen peroxide is increased at the expense of oxygenated organic materials. The maintenance of a proper temperature in the reactor can also be aided by preheating the air to temperatures between ambient temperature up to about 800° F. Where heavy, normally liquid fuels are utilized, it is also advantageous to preheat the fuel so that it can be readily atomized and mixed with the air. The temperature in the burning zone can also be controlled to a certain extent, by dilution of the fuel-air mixture with water. This also prevents undesirable side reactions such as cracking of the hydrocarbons.

The fuel and air are preferably premixed prior to burning or combustion and suitable techniques for accomplishing this will be apparent from the description of the apparatus. In addition, it is highly desirable that the fuel and air pass through the combustion zone as an annularly stratified body with a fuel-rich core and an outer fuel-lean annular shell. Such stratification of the fuel-air mixture in the combustion zone has numerous advantages, including flame stabilization at the very high flow velocities hereinafter mentioned, protection of the walls of the combustion zone, as will be hereinafter detailed, and prevention of decomposition of the hydrogen peroxide, which is known to occur when certain materials, such as metals, are utilized for walls of the combustion zone.

As previously indicated, the burning should be carried out at a very high flow velocity, preferably above about 250 feet per second. If the burning proceeds too slowly, there is also a tendency for the hydrogen peroxide to decompose before the hereinafter mentioned termination of the reaction.

Where premixing of the fuel and air is performed in the apparatus prior to combustion, it is also desirable to prevent flashback of the flame into the mixing zone. This will be more apparent when reference is made to suitable apparatus for carrying out the present invention.

Another very critical factor in the operation of the present invention is the rapid termination of the reaction by, at least in part, injecting additional air and/or water into the flame front. This rapid termination or quenching prevents the reaction from reaching equilibrium and thus, decomposition of the hydrogen peroxide. The rapid termination or quenching is further aided by the manner of introducing the quenching fluid, for example, as a plurality of radially directed jets, also abruptly expanding the flame front immediately adjacent the point of introduction of the quenching fluid and, preferably, reducing the peripheral dimension of the flame front prior to such expansion and introducing the quench fluid before the reduction in dimension, in the reduced dimension portion of the flame front or immediately after reduction in the dimension of the flame front. The manner of doing this will also be explained in more detail in discussing the apparatus.

From the above it is obvious that operation in accordance with the present invention overcomes innumerable problems in connection with the production, handling and use of hydrogen peroxide as an oxidant in the recovery of mineral values.

The entire cooled or quenched effluent from the hydrogen peroxide generation step is then contacted with the solid material containing mineral values. As previously indicated, the solid material may be in the form of mined, crushed and appropriately ground ores, in which case the cooled or quenched effluent is simply passed through a body of the ore. Since the effluent of the hydrogen peroxide generator contains carbon dioxide as a by-product, this by-product has a very distinct advantage, in accordance with the present invention. If the ore has been quenched with water, by simply adding an alkaline material to the water, such as sodium hydroxide, the carbon dioxide and sodium hydroxide in the presence of water form sodium carbonates thus producing an alkaline leach solution in which the oxidized mineral values will be soluble and in which they will thus be removed from the ore. To the extent that the flame front was quenched with air, water containing an appropriate alkaline material can be introduced into the body of ore prior to contacting the same with the generator effluent, it can be introduced into the effluent in the generator downstream of the cooling or quenching point or it can be introduced into the body of ore after the hydrogen peroxide generator effluent. Obviously, quenching with water having an alkaline material added thereto would be most convenient. To the extent that the hydrogen peroxide generator effluent contains insufficient carbon dioxide to thus form alkaline leach solution, a conventional aqueous alkaline leach solution or an aqueous acidic leach solution may be utilized. Such a leach solution can be introduced at any of the previously mentioned points in the process. In some cases, fuels utilized to generate the hydrogen may contain significant amounts of sulfur which, in the presence of water, will produce sulfuric acid. Also, in all cases, thermal $NO_x$ is produced in any combustion process and, to the extent that the fuel contains significant amounts of bound nitrogen, additional $NO_x$ is formed and, in the presence of water, nitric acid will be formed. While such acids are highly corrosive and detrimental in most cases, it should be recognized that corrosion inhibitors can be added and if an acidic leach solution is to be utilized, the presence of such acids will, to some extent, reduce the amount of acid necessary in the leach solution. Any unconverted $SO_x$ and/or $NO_x$ which remains in the effluent when contacted with the ore, has been found to be removed by the passage of the effluent through the ore. Specifically, it has been found that substantially all of the $NO_x$ will be absorbed in earth formations and most of the $SO_x$ will be absorbed by the earth formation while a small amount of the remainder appears in the liquids recovered from the contacting step. Consequently, the method of the present invention has a very distinct advantage in that air pollution, as the result of the production of $SO_x$ and $NO_x$, is substantially eliminated. It is also preferred that the hydrogen peroxide generator effluent be contacted with the solid materials containing the mineral values substantially immediately after generation of the effluent. In this manner, the previously mentioned problems of handling hydrogen peroxide, and particularly the decomposition of hydrogen peroxide during use in accordance with conventional practice, are avoided.

Where a subsurface earth formation containing the mineral values is to be contacted with the hydrogen peroxide generator effluent, this may be done by positioning the generator at the surface of the earth and passing the effluent through a well head and thence down the well to the formation to be treated, positioning the generator in the well head and passing the effluent down the well to the formation to be treated or positioning the generator down the well bore at a point immediately adjacent the formation to be treated. In all cases, the formation of the ultimate leach solution can be carried out in the same manner as previously discussed in connection with the treatment of mined ore. Where the generator is located at the surface of the earth or in the well head, it will be advantageous to quench the flame front with air, rather than water, pass the quenched effluent down tubing in the well and separately introduce water or a leach solution down the annulus between the tubing and the well casing. By operating in this manner, the problems of decomposition of the hydrogen peroxide and passing the same from the surface to the subsurface formation are substantially eliminated, since significant decomposition does not occur until the hydrogen peroxide contacts the water. In addition, the problems of handling hydrogen peroxide solutions, or the like, are also eliminated even if a conventional operation were carried out in which the leach solution and the hydrogen peroxide were separately injected into the well and then mixed adjacent the formation to be treated. However, the much preferred method of operation is to lower the generator into the well bore, generate the hydrogen peroxide immediately adjacent the formation to be treated and contact the formation with the generated effluent, and, in some cases, an additional leach solution, substantially immediately after generation of the effluent. The obvious advantages of such an operation appear from the above discussion, but it should be emphasized that problems with the generation of hydrogen peroxide, the handling of hydrogen peroxide, the known tendency of hydrogen peroxide to deteriorate and the problems of air pollution are significant. The fact that the effluent is at an elevated temperature and an elevated pressure are also quite distinct advantages, since it is known that the recovery of mineral values with leach solutions is enhanced at elevated temperatures and the elevated pressure will aid in forcing the leach solution into and through the formation. There are several ways in which such an in situ extraction process can be carried out. Normally, the effluent and leach solution, if necessary, is introduced into an injection well, then passed through the formation to be treated and then produced from a production well. It should also be recognized that other known techniques can be utilized. For example, a technique similar to the "huff and puff" technique utilized in the recovery of heavy hydrocarbon oils by steam injection can be utilized. This consists essentially of utilizing a single well for injection and production, the injected materials being introduced into the formation and permitted to remain in contact with the formation for a predetermined period of time and thereafter, the fluids being produced through the same well.

While the effluent from the hydrogen peroxide generator will, in most cases, contain other by-products, such as those mentioned above, these materials will not adversely affect the recovery of the mineral values. As a matter of fact, some may even aid in the recovery. Also, to the extent that these by-products are recovered with fluids produced after contacting the solid materials, they can be separated from the produced fluids and utilized for other purposes. For example, if propane or the like is utilized as a fuel, or the fuel contains alkyl hydrocarbons, significant amounts of olefins are known to be produced. These olefins can be recovered and ultimately utilized as a fuel or for other purposes.

By way of illustration, in the partial oxidation of propane with air in a high intensity combustor utilizing water as a quench fluid under conditions to produce maximum amounts of hydrogen peroxide, one would expect the following reaction to occur.

$$100C_3H_8 + 41\tfrac{1}{2}O_2 \longrightarrow 70C_3H_8 + 15C_3H_6 + C_2H_6 + 2C_2H_4 + CH_4 + 13CO + 2CO_2 + 15H_2O_2 + 24H_2O + 3CH_3OH + 2HCHO + 3CH_3CHO + 2CH_3COCH_3 + 2CH_3CH\text{—}CH_2 \text{ (O)}$$

Disregarding the content of unreacted propane and air, along with nitrogen, carbon monoxide, carbon dioxide and other hydrocarbon products in the effluent, the effluent product would be expected to have the following composition of oxygen-containing partial oxidation products.

TABLE I

| Moles | Component | Wt. % | Vol. % |
|---|---|---|---|
| 15 | Hydrogen Peroxide | 51.0 | 36.9 |
| 3 | Methyl Alcohol | 6.6 | 8.7 |
| 2 | Formaldehyde | 6.0 | 7.6 |
| 3 | Acetaldehyde | 13.2 | 17.5 |
| 2 | Acetone | 11.6 | 15.2 |
| 2 | Propylene Oxide | 11.6 | 14.1 |
| 27 | | 100.0 | 100.0 |

Thus if desired, it is obvious that concentrations as high as 15 mol percent hydrogen peroxide can be obtained.

FIG. 1 of the drawings illustrates the basic structure of a hydrogen peroxide generator used in accordance with the present invention. The apparatus of FIG. 1 is designed for the use of a normally gaseous fuel. The apparatus basically comprises a mixing zone 2, a combustion zone 4, a quench or cooling chamber 6 and a discharge nozzle 8. Fuel is introduced through fuel introduction 10, as a generally axial stream, into mixing zone 2. Air is introduced into the mixing zone 2 through an appropriate swirl means 12. Swirl means 12 can be any of the well known means for creating a swirling annular stream of air, such as an annular ring with fins at appropriate angles, a plurality of peripheral, tangential introduction ports or the like. The fuel and air are partially mixed in mixing zone 2 and are then passed through barrier means 14. Barrier means 14 is a suitable perforated grid, which together with the axial introduction of the fuel and the annular introduction of the air creates an annularly stratified body of fluids, which is fuel rich along the axis of combustion zone 4 and fuel-lean adjacent the walls of combustion zone 4. Such stratification prevents the body of fluids from reaching equilibrium oxygen atom concentrations before reaching the quench zone. In addition, the grid absorbs heat and prevents flashback of the flame into fuel-air mixing zone 2. Additionally, this stabilizes the flame in combustion zone 4 at the very high flow velocities employed in accordance with the present invention. Grid 14 also increases the flow velocity. The generator of FIG. 1 is designed for the use of natural gas as a fuel and accordingly, combustion zone 4 is approximately 3 inches in length and three inches in diameter to attain the previously mentioned short residence time. Ignition of the fuel-air mixture is affected by spark plug 16. Quench fluid, in the case illustrated water, is introduced through line 18, passes through annular chamber 20 in indirect heat exchange with the combustion zone, thence, into annular plennum 22 and finally is introduced into the flame front through a plurality of peripherally spaced apertures 24. Utilization of the quench fluid in indirect heat exchange with the combustion zone 4, at least in part, permits the utilization of a metal combustion chamber as opposed to a ceramic lined combustion chamber. A ceramic lined chamber would be easily fractured under the conditions employed in accordance with the present invention. In addition, the use of a metalic combustion chamber permits one to construct a generator having a relatively small diameter, in the case illustrated about six inches in diameter. In the apparatus shown, the quench fluid in passing into the flame front, as a plurality of radial jets, aids in the mixing of the quench fluid with the flame front and thus the abrupt termination of the reaction. In addition, the quench fluid is injected in the vena contracta of a nozzle 26. Nozzle 26 serves to reduce the diameter of the flame front and thereafter expand the same. This reduction and abrupt expansion aid the mixing of the quench fluid with the flame front and also prevents back flow of the quench fluid into the combustion zone. It should be recognized that the quench fluid can be introduced immediately before or immediately after the vena contracta. It should also be recognized that the angle of expansion can be varied within certain limits, in accordance with the present invention. This will be explained in more detail with reference to FIG. 5. A cooled or quenched effluent is then passed to a chamber of suitable dimensions to permit the mixture to achieve a product of uniform composition and velocity. Exhaust nozzle 8 may not be necessary in all cases, since its primary function is to produce a product of uniform composition and velocity. However, nozzle 8 could serve as a mixing nozzle for the addition of chemicals or the introduction of a leach solution by introducing the chemicals or the leach solution immediately before, into, or immediately after the vena contracta of the nozzle 8.

As previously indicated, the generator of FIG. 1 is designed to have maximum diameter of about six inches. This has the advantage of providing a structure capable of safely operating under the conditions utilized herein for the production of hydrogen peroxide. In addition, the generator of FIG. 1 can be readily utilized in a conventional well bore having a casing seven inches in diameter, which is a standard size. It is also possible to construct the generator so as to have a diameter of about twelve inches to thereby fit into a well having a casing of thirteen inches in diameter. In the latter instance, the severe space limitations of a seven-inch casing do not exist and the generator can be designed without indirect cooling by the quench fluid and instead utilizing a conventional blanket-type insulation. It is also possible in this case to utilize a ceramic lined combustion zone.

Figure 2:
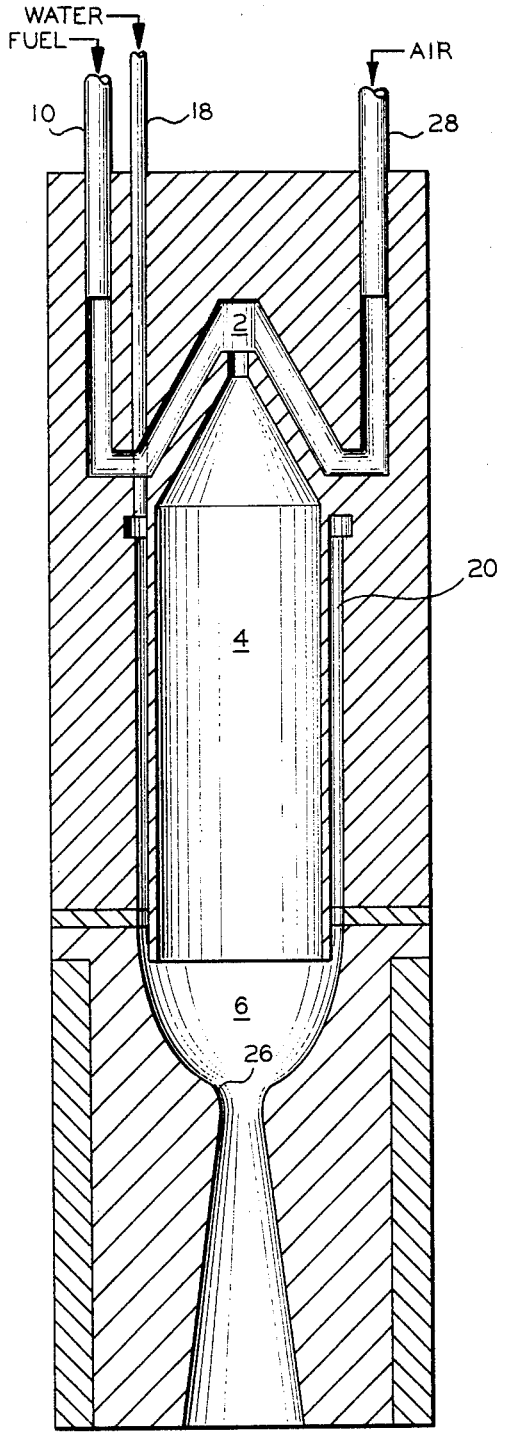
FIG. 2. is a schematic view, partially in cross section, of a modification of generator of FIG. 1.

FIG. 2 of the drawings schematically illustrates a modification of the generator of FIG. 1. The generator of FIG. 2 is also designed primarily for the use of a normally gaseous fuel. In accordance with FIG. 2, fuel is introduced through a line 10 and air through line 28. The fuel and air are thus introduced as opposed jets to achieve a momentum-density balance and thus produce mixing at their plane of intersection. Accordingly, the mixing zone 2 can be of a smaller size. The mixture is then introduced into the combustion chamber 4. Quench fluid is introduced through line 18 and passes in indirect heat exchange with combustion chamber 4 through annular chamber 20 in the same manner as in FIG. 1. However, the quench fluid then contacts the flame front as an annular stream about the flame front being discharged at the downstream end of combustion chamber 4. This mixture is then substantially immediately converged by nozzle 26. This manner of mixing also reduces the nominal size of chamber 6. Otherwise, all of the perameters and features previously discussed with respect to FIG. 1 apply.

Figure 3:
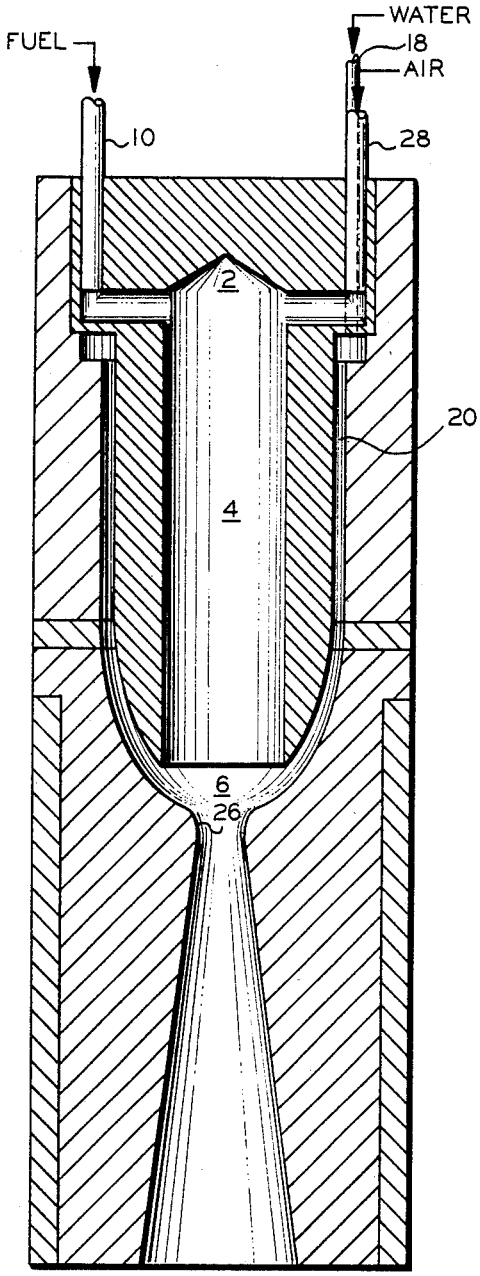
FIG. 3 is a schematic view, partially in cross section, of another modification of the generator of FIG. 1.

FIG. 3 of the drawings shows yet another modification of the apparatus of FIG. 1. In FIG. 3, fuel is introduced through line 10 and air through line 28 in substantially the same manner as in FIG. 2. However, instead of the fuel and air contacting one another in the mixing zone 2 at an acute angle, the fuel and air contact one another, in accordance with FIG. 3, as opposed radial jets. Otherwise the operation of the generator of FIG. 3 is the same as that of FIG. 2 and an appropriate ignition means, such as a spark plug (not shown) would be provided to ignite the fuel-air mixture at the upstream end of combustion chamber 4.

Figure 4:
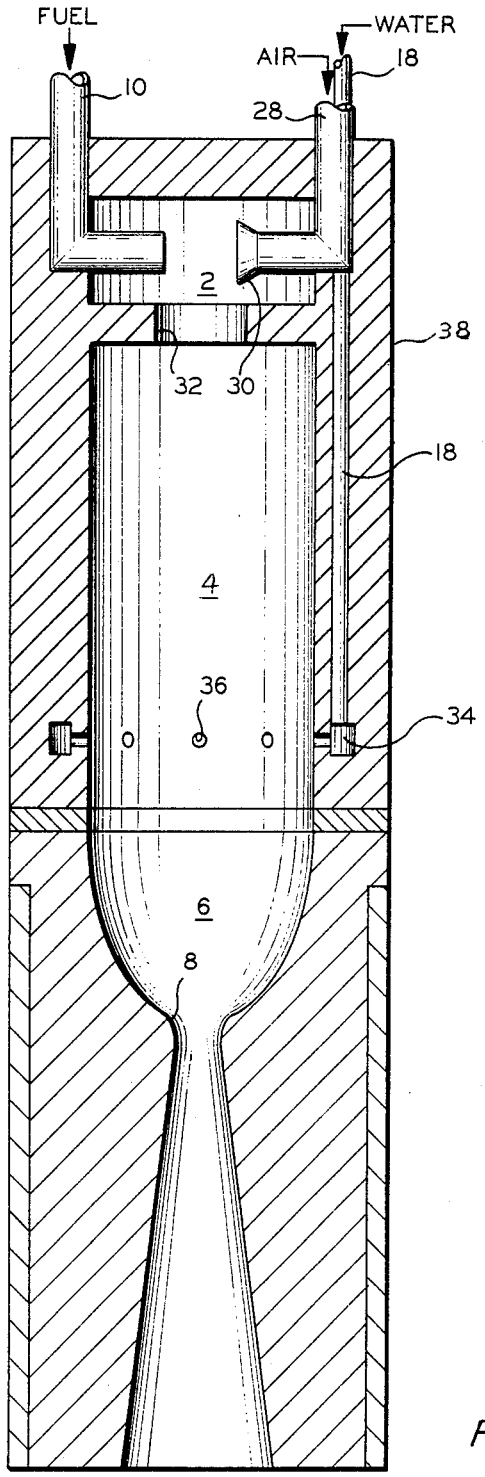
FIG. 4 is a schematic view, partially in cross section, of yet another modification of the generator of FIG. 1.

Still another modification of the generator is shown in FIG. 4. In FIG. 4, fuel and air are introduced through lines 10 and 28, respectively, as previously described and are introduced as opposed radial jets in a manner similar to that of FIG. 3. However, air line 28 is provided with an appropriate spray head 30, which produces a shower head-type effect as the air contacts the fuel. Also, the premixed fuel and air then passes through an orifice 32 which further aids in the mixing by reducing the diameter of the mixture and then abruptly expanding the mixture at an angle of 90° with respect to the wall of the combustion chamber 4. This contraction and abrupt expansion of the mixture also prevents feedback into the mixing chamber 2. Quench fluid is introduced through line 18 but is not utilized as an indirect cooling medium for chamber 4, but instead, passes directly into annular plennum 34 and thence through apertures 36 into the flame adjacent the downstream end of combustion chamber 4. Accordingly, introduction of the quench fluid as a plurality of annularly spaced radial jets performs the function of abruptly terminating the combustion and mixing the quench fluid with the fluids in the flame front. Also, in this configuration, the combustion chamber is surrounded by an appropriately insulated shell 38. The quench for cooled effluent then passes through chamber 6 and through nozzle 8 in essentially the same manner as in FIG. 1.

Of the four generators described to this point, that of FIG. 1 is the preferred construction and better mixing of fuel and air can be attained in a configuration of FIG. 2 as opposed to that of FIGS. 3 and 4.

Figure 5:
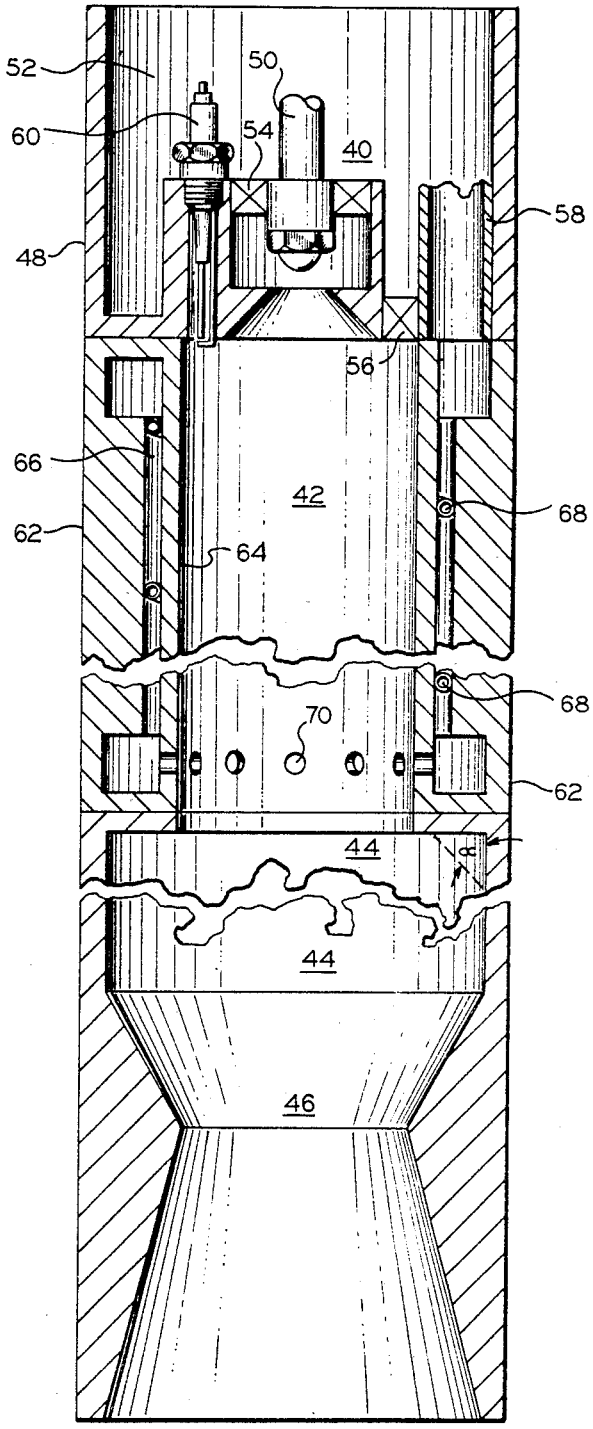
FIG. 5 is an elevational view, partially in cross section, of yet another modification of the generator of FIG. 1.

FIG. 5 of the drawings shows a hydrogen peroxide generator suitable for use when a normally liquid fuel is utilized.

The generator comprises four basic sections or modules, namely, a combustor head 40, a combustion chamber 42, a mixing chamber 44 and an exhaust nozzle 46.

All of the modules are connected in a manner such that they are readily separable for the substitution of alternate subunits, servicing, repair, etc. In some cases, however, the combustion chamber 42 and water mixing chamber 46 can be permanently connected subunits, since the unit can be designed so that these two subunits can be utilized for most types of fuel and most water injection and vaporization rates. In certain instances it may also be desirable to substitute a different exhaust nozzle or a different fuel introduction means. The head 40 has a body portion or outer casing 48. A fuel introduction means 50 is mounted along the axis of casing 48 to introduce fuel centrally and axially into the combustion chamber 42. In the particular instance schematically shown herein, the fuel introduction means 50 is an atomizing nozzle adapted for the introduction of a liquid fuel. Such atomizing nozzles are well known in the art and the details thereof need not be described herein. However, the nozzle may be any variety of spray nozzles or fluid assist nozzles, such as an air assist or steam assist nozzle. Obviously an air assist nozzle, where such assistance is necessary, is preferred if there is no readily available source of steam. This is particularly true where the unit is utilized downhole and surface steam is not readily available. In any event, the nozzle 50 sprays the appropriately atomized liquid fuel in a diverging pattern into the combustion chamber 42. Combustion supporting gas, particularly air, is introduced into a plenum chamber 52 formed within outer casing 48. Obviously, the plenum chamber 52 can be separated into two or more separate plenum chambers for introducing separate volumes of air, as hereinafter described. It is also possible to supply more than one volume of air through separate lines from the surface. This, of course, would provide separate control over each of a plurality of volumes of air beyond that controlled by the cross-sectional area of the air openings in each specific case. It is also possible that each of the air entries to the combustion chamber could be constructed to vary the cross-sectional area of air openings and could be remotely controlled in accordance with techniques known to those skilled in the art. In any event, a first volume of air is introduced around nozzle 50 through a swirler 54. Swirler 54 may be any appropriate air introduction swirler which will introduce the air in a swirling or rotating manner, axially into the combustion chamber 42 and in a downstream direction. The specific variations would include a plurality of fins at an appropriate angle, such as 45° (apex angle of 90°), or a plurality of tangentially disposed inlet channels. In any event, the air then enters combustion chamber 42 as a swirling or rotating annular body, rotating in a clockwise or counterclockwise direction. A second air swirler 56 is formed adjacent the inner wall of combustion chamber 42 and is of essentially the same construction as swirler 54. Swirler 56, in like manner to 54, introduces the air as a swirling or rotating annular body of air along the inner wall of combustor chamber 42. The rotation of the air by swirler 52 and swirler 54 is in opposite directions. Specifically, if the air is rotated in a clockwise direction by swirler 52, it should be rotated in a counterclockwise direction by swirler 54. This manner of introducing the air through swirlers is extremely important in the operation of the unit of the present invention, particularly where fuels having a tendency to deposit carbon and tar on hot surfaces are utilized and to prevent burning of the combustion chamber walls. Also introduced through combustor head 40 is water, through water inlet 58. Also mounted in the combustor head is a suitable lighter or ignition means 60. In the present embodiment, igniter means 60 is a spark plug. However, where fuels having high ignition temperatures are utilized, the igniter means may be a fuel assisted ignition means, such as a propane torch or the like which will operate until ignition of the fuel/air mixture occurs. In some cases, a significant amount of preheating of the fuel or fuel-air mixture is necessary.

The combustion chamber includes an outer casing 62 and an inner burner wall 64, which form an annular water passage 66 therebetween. Water passage 66 is supplied with water through water conduit 58 and cools the combustion chamber. This external cooling with water becomes a significant factor in a unit for downhole operation, since, in some cases, for example where the tool is to be run in a casing with an internal diameter of about 7 inches, the tool itself will have a diameter of 6 inches. This small diameter does not permit mechanical insulation of the combustion chamber and, accordingly, effective cooling is provided by the water. It should be recognized at this point that transfer of heat from the combustion chamber to the water in passage 66 is not necessary. In order to prevent the formation of air bubbles or pockets in the body of cooling water, particularly toward the upper or upstream end of the channel, water swirling means 68 is spirally found in the water channel 66 to direct the water in a spiral, axial direction through the channel. The water swirling means 68 can be a simple piece of tubing or any other appropriate means. A primary concern in the operation of the generator is combustion cleanliness, that is the prevention of deposits on the wall of the combustion chamber and production of soot emissions as a result of incomplete combustion. This becomes a particular problem where heavy fuels are utilized and the problem is aggravated as combustor pressure increases and/or combustion temperature decreases. In any event, the manner of introducing the air into the generator substantially overcomes this problem. The counter rotating streams of air in the combustion chamber provide for flame stabilization in the vortex-flow pattern of the inner swirl with intense fuel-air mixing at the shear interface between the inner and outer streams of air for maximum fuel vaporization. Also, this pattern of air flow causes fuel-lean combustion along the combustion chamber walls to prevent build up of carbonacious deposits, soot, etc. Following passages of the water through channel 66, the water is injected into the combustion products or flue gases from combustion chamber 42 through appropriate holes or apertures 70. Another extremely important factor, in the operation of the hydrogen peroxide generator of the present invention, is the prevention of feedback of excessive amounts of water from the mixing section 44 into the combustion section 42, because of the chilling effect which such feedback would have on the burning of the soot particles which are produced during high pressure combustion. Such feedback is prevented by the axial displacement of the vortex flow patterns from the counter rotational air flow. Another extremely important factor in the operation of the steam generator is the manner of introduction of water into the flue gas. In accordance with the present invention, such introduction is accomplished by introducing the water as radial jets into the flue gases, such jets preferably penetrating as close as possible to the center of the body of combustion products. The combustion products—water mixture is then abruptly expanded as it enters mixing chamber 44. Accordingly, substantially complete mixing will occur and the formation of water droplets or water slugging in the mixture will be eliminated. Abrupt expansion in the present case is meant to include expansion at an angle (alpha) significantly greater than 15°, since expansion at about 15° causes streamline flow or flow along the walls rather than reverse mixing at the expander. By the time the mixture of combustion products and water reach the downstream end of mixing chamber 44, substantially complete mixing is attained.

Figure 6:
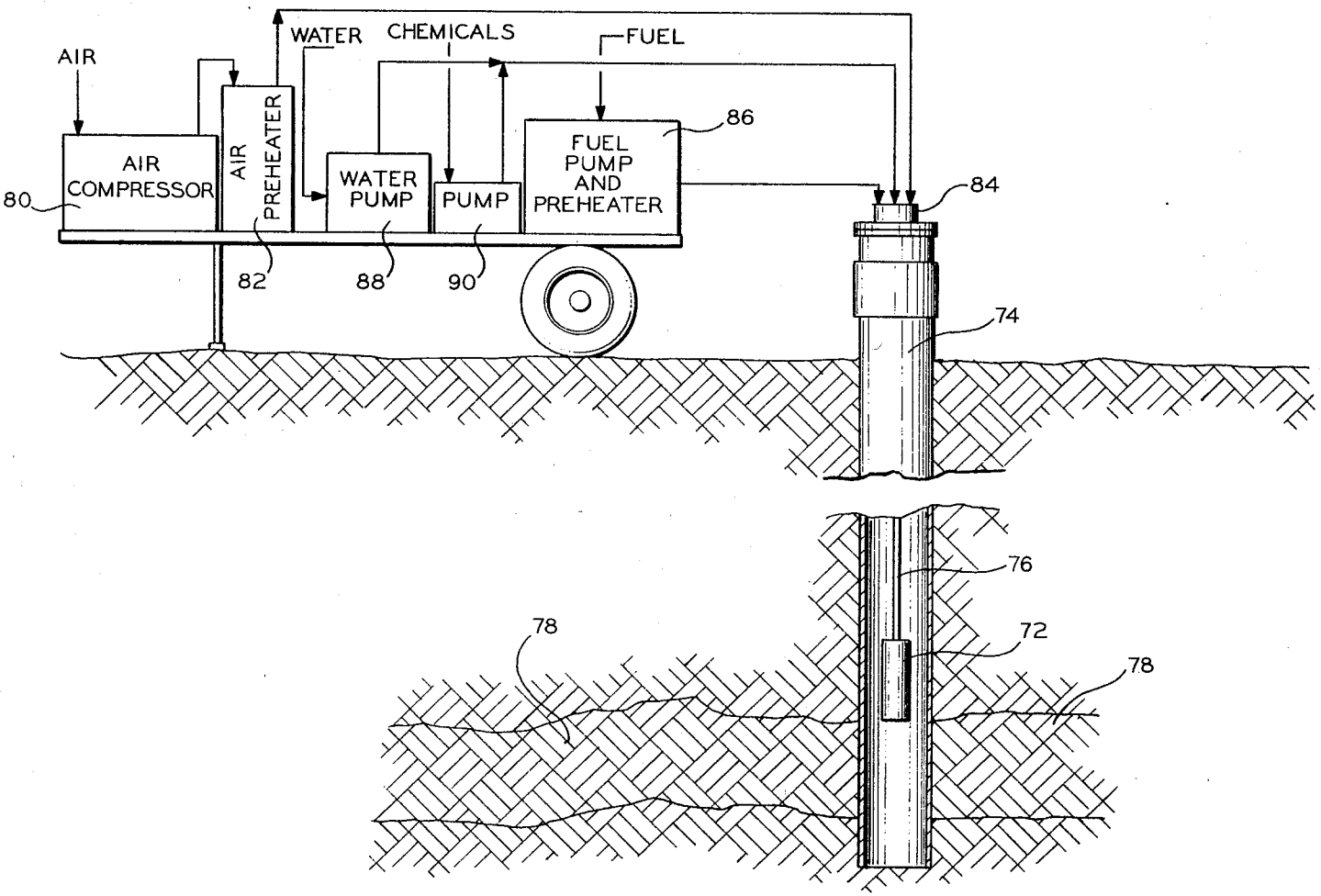
FIG. 6 is an elevational view, partially in cross section, showing equipment for utilizing the present invention in treating subsurface earth formations.

FIG. 6 illustrates support equipment for the operation of the hydrogen peroxide generator of the present invention and illustrates the use of the generator down a wellbore for in situ leaching of mineral values. The support equipment may be mounted on a mobil unit, as shown, or it can be stationary. In addition, economics may dictate that a centralized battery of support equipment or a centralized support unit is provided to supply compressed air to a plurality of different injection wells.

In accordance with FIG. 6 the hydrogen peroxide generator 72 is suspended in casing 74 by an umbilical 76. As illustrated, generator 72 is disposed adjacent subsurface formation 78 containing the mineral values to be extracted and, therefore, will discharge the effluent from the generator substantially directly into subsurface formation 78. Air for the operation of the generator is supplied to an appropriate air compressor 80. The compressed air is then passed to an air preheater 82, where such preheating is desired, which preheats the air to an appropriate temperature for use in a generator. Compressed air is then fed to the generator through well head 84 connected to the top of casing 74. Fuel is introduced through an appropriate pump or fuel pump and preheater 86, depending upon the nature of the fuel. Where the fuel is a normally gaseous fuel, such as natural gas, fuel pump and preheater 86 would be replaced by an appropriate compressor if the gas is not already at an appropriate pressure for use in the generator. The fuel from fuel pump and preheater 86 is then passed to the well head 84. Quench water is introduced to water pump 88 and from the water pump to the well head 84. Where chemicals, such as corrosion inhibitors or alkaline material is to be added to the water, such chemicals can be supplied from a pump 90 and into the water line to well head 84.

While specific materials, specific items of equipment and specific conditions of operation have been set forth herein, it is to be understood that such specifics are by way of illustration only and the present invention is not to be limited in accordance with such recitals.

That which is claimed:

1. A method for the recovery of fossilized organic substances from solid materials containing such fossilized organic substances comprising:

(a) burning a hydrogen-containing fuel in the presence of an oxidizing agent in at least one burning step and under conditions sufficient to produce at least one effluent containing significant amounts of partial oxidation products, including significant amounts of alcohols and at least one material selected from the group consisting of hydrogen peroxide, aldehydes and ketones;

(b) terminating said burning step to prevent significant decomposition of the thus produced partial oxidation products and the formation of products of complete combustion therefrom; and (c) contacting said solid materials containing said fossilized organic substances with said effluent and an alkaline material.

2. A method in accordance with claim 1 wherein a first burning step is carried out under conditions sufficient to produce a first effluent containing significant amounts of partial oxidation products, including at least one material selected from the group consisting of hydrogen peroxide, aldehydes and ketones, and a second burning step is carried out under conditions sufficient to produce a second effluent containing partial oxidation products, including significant amounts of alcohols, and the solid materials are contacted with the first effluent from the first burning step and the alkaline material and, thereafter, with the second effluent from the second burning step.

3. A method in accordance with claim 1 wherein the fossilized organic substances are petroleum present in a subsurface earth formation penetrated by at least borehole, a first burning step is carried out under conditions sufficient to produce a first effluent containing partial oxidation products, including at least one material selected from the group consisting of hydrogen peroxide, aldehydes and ketones, a second burning step is carried out under conditions sufficient to produce a second effluent containing significant amounts of partial oxidation products, including alcohols, the first effluent from the first burning step and the alkaline material are contacted with the solid materials and, thereafter, with the second effluent from the second burning step.

4. A method for the recovery of mineral resources from solid materials containing such mineral resources comprising:

(a) burning a hydrogen-containing fuel in the presence of an oxidizing agent under conditions sufficient to produce an effluent containing significant amounts of partial oxidation products, including at least one material selected from the group consisting of hydrogen peroxide and formaldehyde;

(b) limiting the residence time of said burning step, at least in part, by introducing a quench fluid, comprising an aqueous solution of a material selected from the group consisting of an alkaline material and an acidic material into said effluent; and (c) contacting said solid materials with said effluent containing the thus introduced quench fluid.

5. A method in accordance with claim 4 wherein the mineral resources are fossilized organic materials, the burning step is carried out under conditions sufficient to produce an effluent containing significant amounts of hydrogen peroxide and the solid material is contacted with said effluent, an alkaline material and an oxidation catalyst, whereby components of said fossilized organic substance react with said hydrogen peroxide to form acids and said alkaline material converts said acids to surfactants.

6. A method in accordance with claim 4 wherein the mineral resources are fossilized organic substances, the burning step is carried out under conditions sufficient to produce an effluent containing significant amounts of formaldehyde and the solid materials are contacted with said effluent and an alkaline sulfite, whereby components of said fossilized organic substance react with said formaldehyde and said alkaline sulfite to form surfactants.

7. A method in accordance with claim 4 wherein the mineral resources are fossilized organic substances, the burning step is carried out under conditions sufficient to produce an effluent containing significant amounts of hydrogen peroxide and formaldehydes and the solid contact material is contacted with said effluent, an alkaline material, and an alkaline sulfite, whereby components of said fossilized organic substance react with said hydrogen peroxide to form acids and said alkaline material converts said acids to surfactants and other components of said fossilized organic substance react with said formaldehyde and said alkaline sulfite to form surfactants.

8. A method in accordance with claim 4 wherein the mineral resources are petroleum present in a subsurface earth formation penetrated by at least one borehole, the burning step is carried out in said borehole adjacent said subsurface earth formation and the effluent is injected into said subsurface earth formation.

9. A method for the recovery of mineral resources from solid materials containing such mineral resources, comprising:

(a) burning a hydrogen-containing fuel in the presence of an oxidizing agent under conditions sufficient to produce an effluent containing significant amounts of partial oxidation products;

(b) limiting the residence time of said burning step, at least in part, by introducing a quench fluid into said effluent; and (c) contacting said solid materials with said effluent and a material selected from the group consisting of an alkaline material and an acidic material.

10. A method in accordance with claim 9 wherein the mineral resources are fossilized organic substances.

11. A method in accordance with claim 10 wherein the burning step is carried out under conditions sufficient to produce partial oxidation products, including at least one material selected from the group consisting of hydrogen peroxide, aldehydes, ketones and esters.

12. A method in accordance with claim 11 wherein the burning step is carried out under conditions sufficient to produce partial oxidation products containing significant amounts of hydrogen peroxide and the effluent and the alkaline material are contacted with the solid material, whereby components of the fossilized organic substance react with said hydrogen peroxide to form acids and said alkaline material converts said acids to surfactants.

13. A method in accordance with claim 11 wherein the burning step is carried out under conditions sufficient to produce partial oxidation products containing significant amounts of formaldehyde and the solid materials are contacted with the effluent and an alkaline sulfite, whereby the components of the fossilized organic substance react with said formaldehyde and said alkaline sulfite to form surfactants.

14. A method in accordance with claim 11 wherein the burning step is carried out under conditions sufficient to produce partial oxidation products containing significant amounts of hydrogen peroxide and formaldehyde and the solid materials are contacted with the effluent, the alkaline material and an alkaline sulfite, whereby components of the fossilized organic substance react with said hydrogen peroxide to form acids and said alkaline material converts said acids to surfactants and other components of said fossilized organic substances react with said formaldehyde and said alkaline sulfite to produce surfactants.

15. A method in accordance with claim 11 wherein the fossilized organic substances are petroleum present in a subsurface earth formation penetrated by at least one borehole.

16. A method in accordance with claim 15 wherein the burning step is carried out at the surface of the earth, the effluent is passed down the borehole and into the subsurface earth formation and the alkaline material is separately passed down the borehole and into said subsurface formation.

17. A method in accordance with claim 15 wherein the burning step is carried out in the borehole adjacent the subsurface earth formation and the effluent and the alkaline material are injected into said subsurface earth formation.

18. A method in accordance with claim 9 wherein the quench fluid is an aqueous solution of the material selected from the group consisting of an alkaline material and an acidic material.

19. A method in accordance with claim 18 wherein the mineral resources are multivalent, metallic minerals.

20. A method in accordance with claim 19 wherein the burning step is carried under conditions sufficient to produce partial oxidation products containing significant amounts of hydrogen peroxide.

21. A method in accordance with claim 20 wherein the solid material is contacted with the effluent and an aqueous alkaline leach solution adapted to extract the metallic minerals from said solid material.

22. A method in accordance with claim 20 wherein the solid material is contacted with the effluent of the burning step and an aqueous acidic leach solution adapted to extract the metallic minerals from said solid material.

* * * * *